United States Patent [19]

Montgomery et al.

[11] Patent Number: 4,790,378

[45] Date of Patent: Dec. 13, 1988

[54] WELL TESTING APPARATUS

[75] Inventors: Carlos E. Montgomery, Anchorage, Ak.; Craig L. Zitterich, Carrollton; Ricky M. Holloman, Lewisville, both of Tex.

[73] Assignee: Otis Engineering Corporation, Dallas, Tex.

[21] Appl. No.: 12,076

[22] Filed: Feb. 6, 1987

[51] Int. Cl.[4] ..... E21B 47/06

[52] U.S. Cl. ..... 166/66; 73/155; 166/72; 166/142; 166/242; 166/250; 166/313; 166/332; 307/118

[58] Field of Search ..... 166/250, 65.1, 386, 166/313, 66, 72, 142, 133, 242, 332, 53; 73/155; 307/118, 119

[56] References Cited

U.S. PATENT DOCUMENTS

| | | | |
|---|---|---|---|
| Re. 31,313 | 7/1983 | Fredd et al. | 166/250 |
| 3,323,361 | 6/1967 | Lebourg | 73/155 |
| 3,327,781 | 6/1967 | Nutter | 166/250 |
| 3,382,928 | 5/1968 | Phillips et al. | 166/332 |
| 4,051,897 | 10/1977 | Kingelin | 166/125 |
| 4,069,865 | 1/1978 | Gazda et al. | 166/113 |
| 4,134,452 | 1/1979 | Kingelin | 166/133 |
| 4,149,593 | 4/1979 | Gazda et al. | 166/113 |
| 4,159,643 | 7/1979 | Watkins | 166/250 X |
| 4,252,195 | 2/1981 | Fredd | 166/314 |
| 4,274,485 | 6/1981 | Fredd | 166/250 |
| 4,278,130 | 7/1981 | Evans et al. | 166/332 |
| 4,286,661 | 9/1981 | Gazda | 166/316 |
| 4,373,583 | 2/1983 | Waters | 166/113 |
| 4,417,470 | 11/1988 | McCracken et al. | 73/154 |
| 4,426,882 | 1/1984 | Skinner | 73/155 |
| 4,487,261 | 12/1984 | Gazda | 166/264 |
| 4,553,428 | 11/1985 | Upchurch | 73/155 X |
| 4,553,599 | 11/1985 | Glotin | 166/332 |
| 4,568,933 | 2/1986 | McCracken et al. | 340/856 |
| 4,583,592 | 4/1986 | Gazda et al. | 166/250 |
| 4,678,035 | 7/1987 | Goldschild | 166/250 |

OTHER PUBLICATIONS

A Brochure entitled "MUST", Published by Flopetrol Johnston, 4 pages.

*Primary Examiner*—Hoang C. Dang
*Attorney, Agent, or Firm*—Albert W. Carroll

[57] ABSTRACT

Well testing apparatus for running on a single-conductor electric cable for gathering reservoir information, the apparatus utilizing two pressure gages and a valve, the valve being landable in a downhole receptacle and being operable to shut in the well or to open it for flow by tensioning or relaxing the electric cable, one of the gages sensing well pressures below the valve and the other gage sensing pressures above the valve, both pressure gages sending signals to the surface corresponding to the pressures sensed thereby both while the well is shut in and while it is flowing, the pressure signals being processed by surface readout equipment for real-time display, recording and/or printout, the apparatus including, if desired, a temperature sensor which sends appropriate signals to the surface which not only indicate the well temperatures sensed but the temperatures are used by a computer and its software to automatically correct the pressure readings for temperature affects. Well testing methods are disclosed as are, also, electronic toggling and sequencing devices for use in downhole test tools for switching power from instrument to instrument in the test tool string in predetermined sequence in order to receive signals from each such instrument in turn.

30 Claims, 9 Drawing Sheets

WELL TESTING APPARATUS

BACKGROUND OF THE INVENTION

1. Field of the Invention

This invention relates to well tools and more particularly to apparatus and methods for testing wells, particularly existing wells, for obtaining information needed for reservoir analysis.

2. Description of the Prior Art

For many years downhole well data were generally obtained by lowering a bottom hole pressure gage into a well on a wire line after the well had been closed in for a period, say 48 to 72 hours, to permit the well bore pressure to equalize with that of the surrounding producing formation. A maximum recording thermometer was generally run with the gage. Pressure readings were often made at several locations, and especially at or near the formation. After obtaining such static readings, the well was then placed on production and pressure readings taken while the well was flowing. Thus, information was obtained on the drawdown and the build-up characteristics of the producing formation. In recent years, well testing and reservoir analysis have become more highly developed and efficient. The information gathered as a result of such well testing is subsequently evaluated by reservoir technicians to aid in their efforts to determine with greater accuracy the extent, shape, volume, and contents of the reservoir tested.

Formerly, flow tests were conducted while controlling the flow with valves located at the surface, but in recent years, many tests have been conducted using well tools which control the flow of the well at a location at or close to the formation. Thus the build-up and drawdown periods are shortened considerably and the information obtained is more accurate. Tools for such testing are generally run on an electric cable and include a valve which is landed in a receptable near the level of the formation and which may be opened and closed merely by tensioning and slacking the cable. Included in the tool string is generally a pressure sensor which senses the pressure below the valve at all times and sends suitable signals via the cable to the surface where the signal is processed by surface readout equipment for display and/or recording. Such signals are sent at intervals, say every few seconds, or every few minutes.

Known prior art U.S. patents are: U.S. Pat. Nos. Re 31,313, 2,673,614, 2,698,056, 2,920,704, 3,208,531, 4,051,897, 4,069,865, 4,134,452, 4,149,593, 4,159,643, 4,252,195, 4,274,485, 4,278,130, 4,286,661, 4,373,583, 4,417,470, 4,426,882, 4,487,261, 4,568,933, 4,583,592.

Also, Applicant is familiar with a brochure published by Flopetrol-Johnston covering their MUST Universal DST (Drill Stem Test) device.

In addition, they are familiar with the landing nipples and lock mandrels illustrated on page 5972 of the Composite Catalog of Oil Field Equipment and Services, 1980–81 Edition, published by WORLD OIL magazine. Those landing nipples and locking devices are based upon U.S. Pat. No. 3,208,531.

U.S. Pat. No. 4,051,897 issued to George F. Kingelin on Oct. 4, 1977; U.S. Pat. No. 4,069,865 issued Jan. 24, 1978 to Imre I. Gazda and Albert W. Carroll; U.S. Pat. No. 4,134,452 issued to George F. Kingelin on Jan. 16, 1979; U.S. Pat. No. 4,149,593 issued to Imre I. Gazda, et al, on Apr. 17, 1979; U.S. Pat. No. 4,159,643 issued to Fred E. Watkins on July 3, 1979; U.S. Pat. No. 4,286,661 issued on Sept. 1, 1981 to Imre I. Gazda; U.S. Pat. No. 4,487,261 issued to Imre I. Gazda on Dec. 11, 1984; U.S. Pat. No. 4,583,592 issued to Imre I. Gazda and Phillip S. Sizer on Apr. 22, 1986; and U.S. Pat. No. Re. 31,313 issued July 19, 1983 to John V. Fredd and Phillip S. Sizer, on reissue of their original U.S. Pat. No. 4,274,485 which issued on June 23, 1981, all disclose test tools which may be run on a wire line or cable and used to open and close a well at a downhole location by pulling up or slacking off on the wire line or cable by which test tools are lowered into the well. In some of the above cases, a receptacle device is first run on a wire line and anchored in a landing nipple, then a probe-like device is run subsequently and latched into the receptacle. In the other cases, the receptacle is run in as part of the well tubing.

U.S. Pat. Nos. 4,051,897; 4,069,865; and 4,134,452 provide only a tiny flow passage therethrough openable and closable by tensioning and relaxing the conductor cable for equalizing pressures across the tool.

U.S. Pat. No. 4,149,593 is an improvement over the device of U.S. Pat. No. 4,134,452 and provides a much greater flow capacity as well as a latching sub which retains the tool in the receptacle with a tenacity somewhat proportional to the differential pressure acting thereacross.

U.S. Pat. No. 4,286,661 is a division of U.S. Pat. No. 4,149,593, just discussed, and discloses an equalizing valve for equalizing pressures across the device disclosed in U.S. Pat. No. 4,149,593.

U.S. Pat. No. 4,159,643 discloses a device similar to those mentioned above and has a relatively small flow capacity. This tool has lateral inlet ports which are closed by tensioning the conductor cable.

U.S. Pat. No. 4,373,583 discloses a test tool similar to those just discussed. It carries a self-contained recording pressure gage suspended from its lower end and therefore sends no well data to the surface during the testing of a well. This tool, accordingly, may be run on a conventional wire line rather than a conductor line, since it requires no electrical energy for its operation.

The MUST Drill Stem Test Tool of Flopetrol-Johnston disclosed in the brochure mentioned above provides a nonretrievable valve opened and closed from the surface by tensioning and relaxing the conductor cable connected to the probe-like tool latched into the valve. Even with the valve open and the well producing, no flow takes place through the probe. All flow moves outward through the side of the valve into bypass passages which then empty back into the tubing at a location near but somewhat below the upper end of the probe. The device provides considerable flow capacity. The probe automatically releases when a predetermined number (up to twelve) of open-close cycles have been performed.

U.S. Pat. No. 2,673,614 issued to A. A. Miller on Mar. 30, 1954; U.S. Pat. No. 2,698,056 which issued to S. J. E. Marshall et al. on Dec. 28, 1954; U.S. Pat. No. 2,920,704 which issued to John V. Fredd on Jan. 12, 1960; and U.S. Pat. No. 3,208,531 issued to J. W. Tamplen on Sept. 28, 1965 disclose various well-known devices for locking well tools in a well flow conductor.

U.S. Pat. No. 2,673,614 shows keys having one abrupt shoulder engageable with a corresponding abrupt shoulder in a well for locating or stopping a locking device at the proper location in a landing receptacle for its locking dogs to be expanded into a lock recess in the receptacle. A selective system is disclosed wherein a series of similar but slightly different receptacles are placed in a tubing string. A locking device is then provided with a selected set of locator keys to cause the device to stop at a preselected receptacle.

U.S. Pat. No. 3,208,531 discloses a locking device which uses keys profiled similarly to the keys of U.S. Pat. No. 2,673,614 but performing both locating and locking functions.

U.S. Pat. No. 4,252,195 discloses use of a pressure probe run on an electric cable and engaged in a transducer fitting downhole. The well is opened and shut by a valve near the transducer fitting in response to the differential pressure between annulus pressure and tubing pressure while signals are transmitted to the surface by the pressure gage to indicate the pressures sensed thereby.

U.S. Pat. No. 4,278,130 discloses apparatus having a ball valve for opening and closing the well while a pressure probe engaged in a spider receptacle senses well pressure in either flow or shut-in state and sends appropriate signals to the surface indicating the pressures measured.

U.S. Pat. No. 4,426,882 discloses drill stem test apparatus which includes an electric pressure gage with surface readout. The downhole valve of the test apparatus is controlled electro-hydraulically to open and close the well at the test tool.

U.S. Pat. No. 4,568,933 discloses a test tool to be run into a well on a single electric cable. Sensors carried by the tool sense, for instance, fluid pressure, temperature, fluid flow and its direction, and the presence of pipe collars, and sends corresponding signals to the surface readout equipment for real-time display and/or recording. All such signals are transmitted via the single-conductor electric cable.

U.S. Pat. No. 4,417,470 discloses an electronic temperature sensor for use in a downhole well test instrument, the sensor having a very rapid response to changes in well fluid temperatures.

The present invention is an improvement over the inventions disclosed in U.S. Pat. Nos. 4,149,593; 4,159,643; 4,487,261; 4,583,592; and Re. 31,313 (originally 4,274,485), and these patents are incorporated into this application for all purposes by reference thereto.

Using known tools and methods such as disclosed in some of the patents discussed hereinabove, a well may be closed in at a location near the producing formation to allow the natural formation pressure to build beneath the well packer, or opening the well to flow to cause a drawdown of pressure, such build-up and drawdown pressures being monitored by the test tool and signals corresponding to the pressures measured sent to a surface readout to display and/or record the test information in real time for evaluation as desired.

There was not found in the prior art an invention disclosing test apparatus providing a test tool having a valve engageable in a landing receptacle and provision for monitoring the pressures both above and below the shut-in point and transmitting such test information to a surface readout for real-time display and/or recording.

SUMMARY OF THE INVENTION

The present invention is directed to well test tools, systems of such tools, and methods of testing well through use of such test tools and systems.

More particularly, the invention is directed to well test tools for running on a single-conductor cable and having dual bottom hole pressure gages in conjunction with a valve mechanism which is landable in the well tubing in locked and sealed relation, the valve being openable and closable by tensioning and slacking the cable, the pressure gages sensing well pressures above and below the valve and generating corresponding electrical signals which are then transmitted via the single electric conductor in the cable to a surface readout which receives and processes such electrical signals for real-time display and/or recording. In other aspects the invention is directed to systems and methods: the systems being directed to the test tool apparatus in combination with a well; the methods being directed to running a test tool string into a well and landing it in a receptacle, alternately flowing the well and shutting it in at the receptacle, and determining conditions in the well both above and below the receptacle both while the well is flowing and while the well is shut in.

It is therefore one object of this invention to provide an improved well test tool having dual electrically-powered bottom hole pressure gages for sensing well pressures above and below a shut-in level in a well and sending signals to the surface via an electric cable on which the test tool is lowered into the well, the signals corresponding to the pressures sensed by the pressure gages.

Another object is to provide a test tool of the character described wherein an electronic switch toggles at predetermined intervals to alternately supply electrical power to first one pressure gage and then the other.

Another object is to provide a well test tool of the character described wherein a temperature sensor is associated with one of the pressure gages and generates signals corresponding to the temperatures sensed and transmits such signals to the surface via the electric cable concomitantly with the signals being transmitted by the pressure gage with which the temperature sensor is associated.

Another object is to provide a well test tool of the character described and including a valve adapted to be landed in a landing receptacle in locked and sealed relation therewith, the valve being openable and closable in response to tensioning and slacking the electric cable.

Another object is to provide a test tool of the character described wherein well pressure below the valve is transmitted to one of the pressure gages at all times.

Another object is to provide a test tool such as that described in combination with an electric cable and surface readout equipment.

Another object is to provide a system for testing a well having a packer sealing between its tubing and casing above a producing formation using a test tool which locks and seals in the well tubing and having a valve which is opened and closed by tensioning and slacking an electric cable connecting the test tool with readout equipment at the surface, the test tool including two electrically powered pressure gages which sense pressure and send corresponding signals to the surface readout equipment for display and/or recording, one of the pressure gages sensing well pressure below the valve and the other of the gages sensing well pressure above the valve.

Another object is to provide such a system wherein the valve is landed in a landing receptacle which is a part of the well tubing.

Another object is to provide a system of the character described wherein the well has two producing zones, the well packer is located between the two zones, and one of the pressure gages senses the pressure of the lower zone while the other of the gages senses pressure of the upper zone.

Another object is to provide such a system in which information is obtained which indicates the drawdown and build-up of at least one of the producing formations at the well bore.

Another object is to provide methods for using test tools such as those described in systems such as those described to obtain information such as flowing pressures and shut-in pressure useful in procedures in evaluating and analyzing the producing reservoirs.

Another object is to provide a method of testing a well by lowering a transducer thereinto and landing it in a receptacle, alternately flowing and shutting-in the well, and determining conditions both above and below the receptacle both while the well is flowing and while the well is shut in.

Another object is to provide an electronic toggle switch for use in well testing for receiving electrical power and signals from the surface via a single-conductor electric cable and alternately switching power to two pressure gages which sense well pressures and alternately send corresponding signals to the surface to indicate the magnitudes of the pressures sensed.

Another object is to provide an electronic sequencing device similar to the toggling device just mentioned but having the ability to control a plurality of devices by turning them on and off in a predetermined sequence.

Other objects and advantages may become apparent from reading the description which follows and from studying the drawing wherein:

DESCRIPTION OF THE PREFERRED EMBODIMENTS

Figure 1:
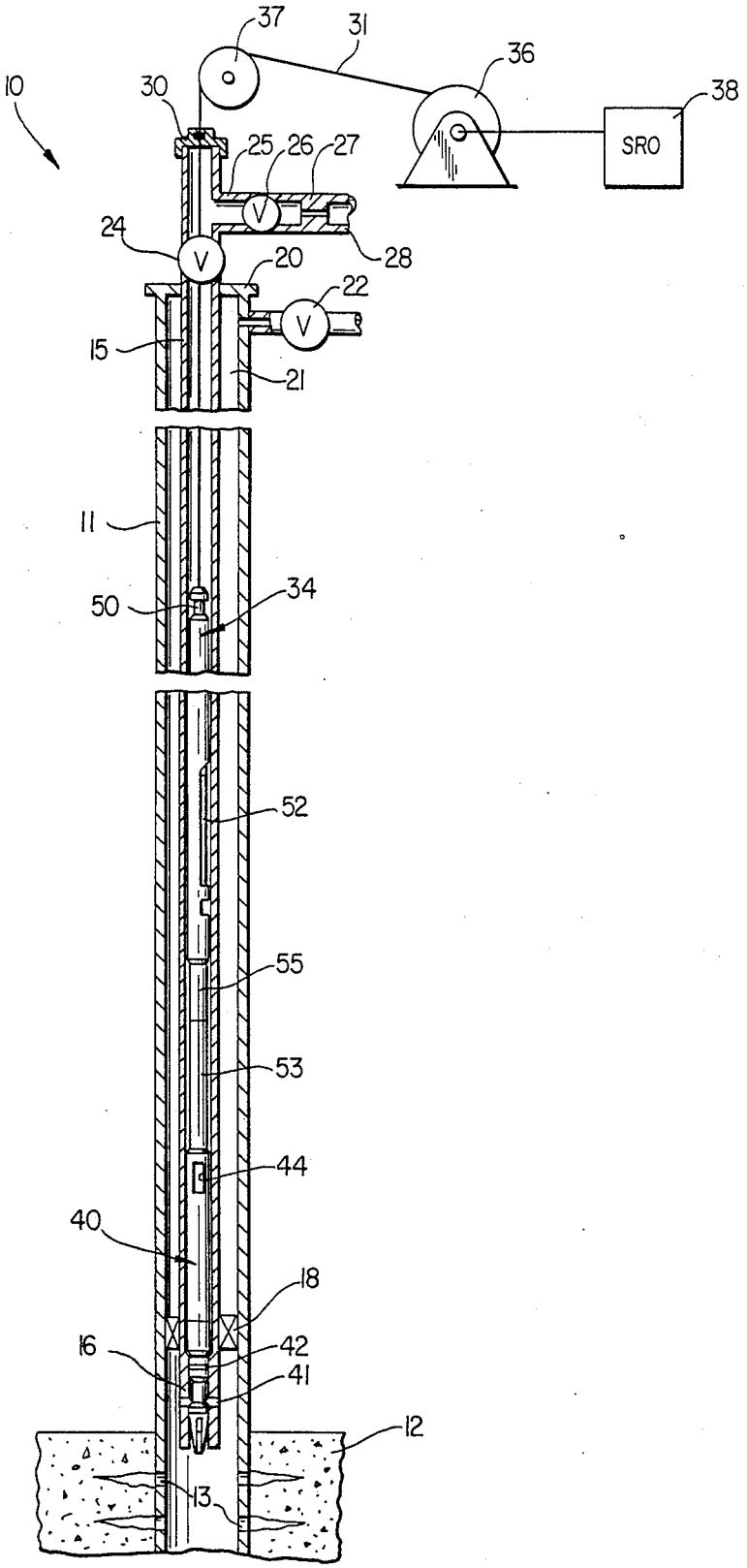
FIG. 1 is a schematical view showing a single-zone well undergoing testing through practice of the present invention.

Referring now to FIG. 1 it will be seen that the well is provided with a well casing 11 extending from the surface down into the producing formation 12 and that the casing is provided with perforations 13 which provide communication between the well casing 11 and the producing formation 12. A tubing string 15 is disposed in the well casing and is provided with a landing receptacle 16 at its lower end, as shown, or near the producing zone 12 while a packer 18 seals between the tubing and the casing immediately above the producing zone 12.

The upper end of the casing is provided with a wellhead 20 which seals the tubing casing annulus 21 about the upper end of the tubing 15. Just below the wellhead, the casing 11 is provided with a wing valve 22 through which the fluids may be introduced into the annulus 21, or through which fluids may be withdrawn from the well. Above the wellhead 20 a conventional Christmas tree provides a master valve 24, and above the master valve is a flow wing 25 having a wing valve 26 beyond which is a surface choke 27 for controlling flow from the well into the flow line 28. The surface choke 27 may be fixed or adjustable, and it may be readily replaceable. As shown, the top of the Christmas tree is provided with a stuffing box 30 through which an electric cable 31 passes into the well to a transducer probe or tool string 34. In actual practice, the stuffing box is generally at the upper end of a lubricator attached to the upper end of the Christmas tree and which can house the tool string 34 carried at the lower end of the cable 31. The electric cable passes from a reel 36 over a sheave 37 as shown and the upper end of the wire which is on the reel 36 is connectable to surface readout equipment indicated by the reference numeral 38.

The tool string 34 is shown in position for testing the formation 12. The tool string 34 is provided with a valve section 40 which is disposed in the landing receptacle 16 so that the lugs 41 of the landing receptacle latch the tool string in position while the seal 42 prevents leakage of well fluids between the valve and the receptacle. The valve mechanism 40 has a valve therein which may be operated from the surface by tensioning or slacking the electric cable 31 (as taught in U.S. Pat. Nos. 4,487,261; 4,583,592; and 4,149,593). When the cable 31 is slacked the valve is open and well fluids may flow from beneath the packer 18 upwardly through the valve to exit therefrom through the exit port 44 into the tubing string surrounding the tool string and from thence flow upwardly to the surface, pass through the master valve 24, the wing valve 26, the surface choke 27, and into the flow line 28. When the valve 40 is closed such flow cannot take place and fluids entering the well bore through the perforations 13 will build up below the closed valve until they equal or stabilize with the pressure in the formation. Information concerning this build-up of pressure in the well is of importance in analyzing the characteristics of the well production reservoir. Also, when the well is allowed to flow after a shut-in period the information concerning the drawdown of the pressure beneath the valve 40 is of great interest in analyzing the characteristics of the producing formation.

The valve 40 may be provided with a choke of suitable orifice or at least have a choke associated therewith in which case it may be desirable to obtain information as the pressures on both sides of the choke as the well is allowed to drawdown. To perform such a test requires two pressure gages downhole. The well tool string 34 contains two gages which may be used for such well testing operation.

The tool string 34 is provided with a rope socket 50 by which the cable 31 is connected to the tool string, a first electronic pressure gage 52, and a second electronic gage 53, both of which may be of the type marketed under the name Hewlett-Packard. If desired, an electronic temperature sensor 55 may be included in the tool string 34, as shown. The tool string includes all of the electronic circuitry required to operate the pressure gages and the temperature sensor. Electrical power is supplied from the surface by equipment included in or connected to the surface readout equipment 38 and this power is supplied through the cable 31 to the tool string.

The lower pressure gage 53 communicates at all times with the well pressure beneath the valve 40 regardless of whether the valve is open or closed. The upper pressure gage 52 is communicated with the pressure above the valve at all times. Each of the pressure gages is provided with its own electronic circuitry and with quartz crystal means for sensing well pressure and, in response thereto, generating an appropriate electric signal which is transmitted to the surface through the electric cable 31 to the surface readout equipment. The surface readout equipment receives the signals sent from the gages and processes them for display on a cathode ray tube and/or for recording.

Figure 6:
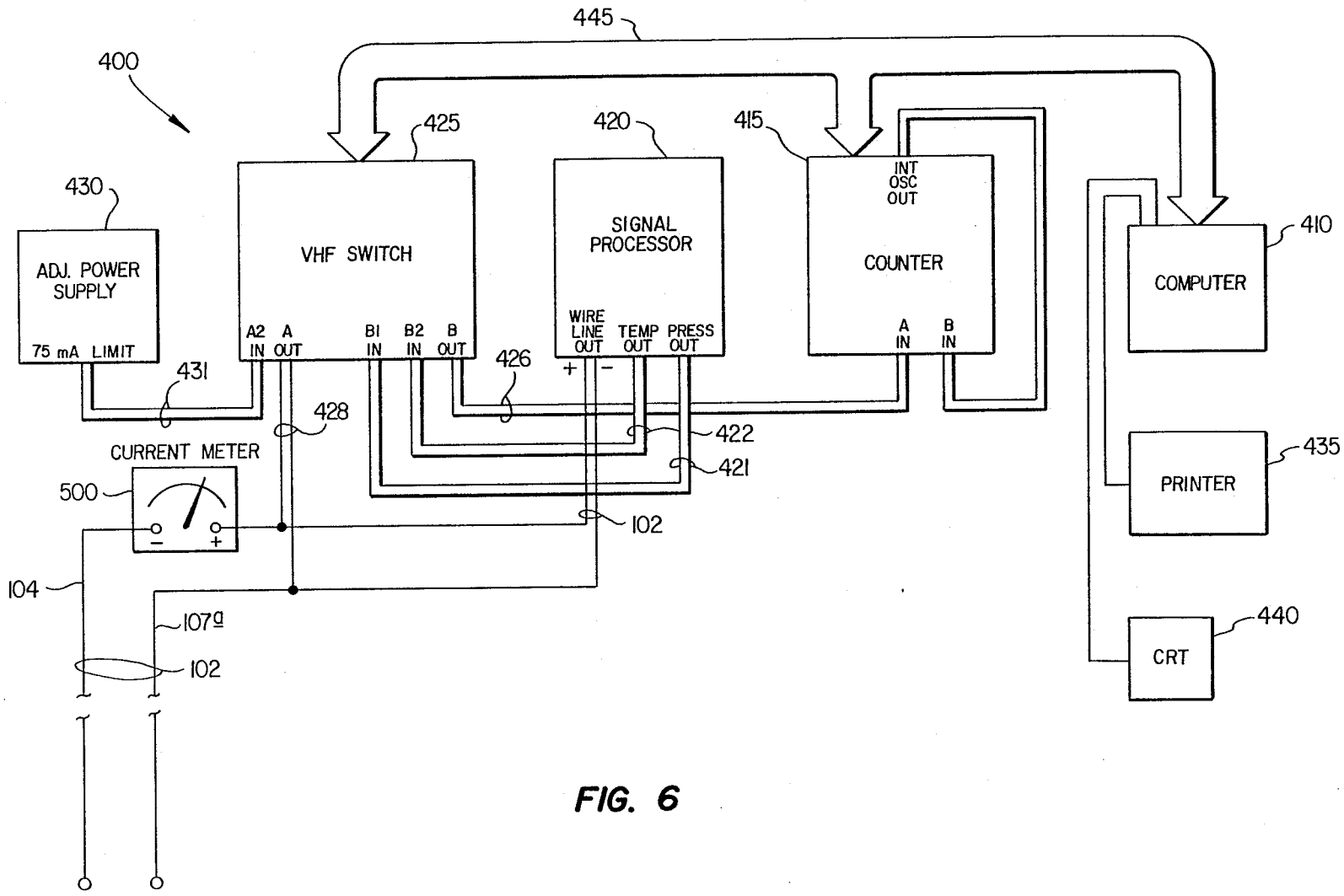
FIG. 6 is a schematical view of the surface readout equipment.

The electronic circuitry in the tool string includes an electronic toggle switch which utilizes a small amount of power from the cable 31 and alternately turns on each of the pressure gages so that each gage, in turn, will send signals to the surface corresponding to the magnitude of the pressures sensed thereby. The electronic toggle switch, in response to an electrical pulse sent down from the surface through cable 31, will turn on gage 53. This electrical pulse may be either a momentary decrease or increase in current. In the circuitry described herein, it is the latter. Gage 53 will generate a signal corresponding to the pressure sensed thereby and this signal will be sent to the surface through the electric cable. When this has been done, the toggle switch turns off gage 53 and turns on gage 52, after which gage 52 will generate a signal corresponding to the pressure sensed thereby, and this signal will likewise be sent to the surface to be processed by the surface readout equipment for display and or recording. Each time, the toggling of the toggle switch is accomplished in response to an electrical pulse sent to the transducer probe from the surface through cable 31. The toggling interval is provided by a computer under control of suitable software. The computer is a part of the surface readout equipment as shown in FIG. 6 and which will be explained later. The interval is adjustable over an extremely wide range from about one second to 24 hours or possibly more. The interval must be long enough to assure accurate readings. It is common practice to trigger the toggle switch about every ten seconds although reliable results should be obtainable with shorter intervals, but probably not much shorter than 3 seconds.

The surface readout equipment, as will be described later, preferably will include a computer and a printer so that the information sent to the surface from the pressure gages downhole may be stored in the computer and may be processed and printed out at the jobsite in a suitable form as controlled by a suitable software. Also included would be a CRT for displaying information, a signal processor, and other equipment such as power supply equipment and VHF switching equipment whose functions will be explained later with respect to FIG. 6.

Preferably, the temperature sensing means 55 is operationally associated with the lower pressure gage 53 although it possibly could be associated with the upper pressure gage if desired. The temperature gage 55 generates a signal corresponding to the temperature sensed thereby and transmits this signal to the surface through cable 31 at the same time or concomitantly with signals from the pressure gage to which it is connected. The surface readout equipment has provisions for separating the temperature signals from the pressure signals and processing them separately. The temperature sensor provides not only information which may be valuable for evaluating the test of the producing formation but also useful in applying temperature correction factors to the signals from the pressure gages 52 and 53, these correction factors being automatically applied through suitable computer software. Thus, when the test information is printed out the pressures will already be corrected and analysis of the information will be thus expedited.

It may be readily understood that the preferable location for the temperature sensor is between the upper and lower gages 52 and 53, as shown.

It is readily understood that in testing the well 10 to gather reservoir information for analysis purposes, a method has been performed. This method involves steps of providing and assembling a test tool string consisting of a valve which can be landed in a landing receptacle in a well in latched and sealed relation therewith, the valve mechanism thereof being operable between open and closed positions by pulling up or slacking off on the electric cable by which the tool train is lowered into the well, the tool train being provided with first and second pressure sensors each of which is capable of sending signals to the surface corresponding to the pressures sensed by the individual gages, this information being received at the surface by readout equipment which is able to process the signals for display and/or recording.

A method of lesser scope comprises the steps of providing an electric conductor line and surface readout equipment for use therewith, assembling a test tool string consisting of a valve having latch and seal elements thereon and having first and second pressure gages forming a part thereof, lowering the tool string into the well on the electric line, engaging said latch means with the well tubing near the formation to be tested, opening and closing said valve by tensioning and slacking the electric cable to permit the well to flow and to prevent the well fron flowing, and processing signals received from the first and second pressure gages during periods that the well is flowing and shut in for display and/or recording.

It is understood that the well testing can be carried out with different size chokes in the valve 40 and also with different size surface chokes 27, if desired.

The valve 40 may be like, or similar to, the valve illustrated and described in U.S. Pat. Nos. 4,149,593; 4,286,661; 4,487,261; or 4,583,592.

Figure 2:
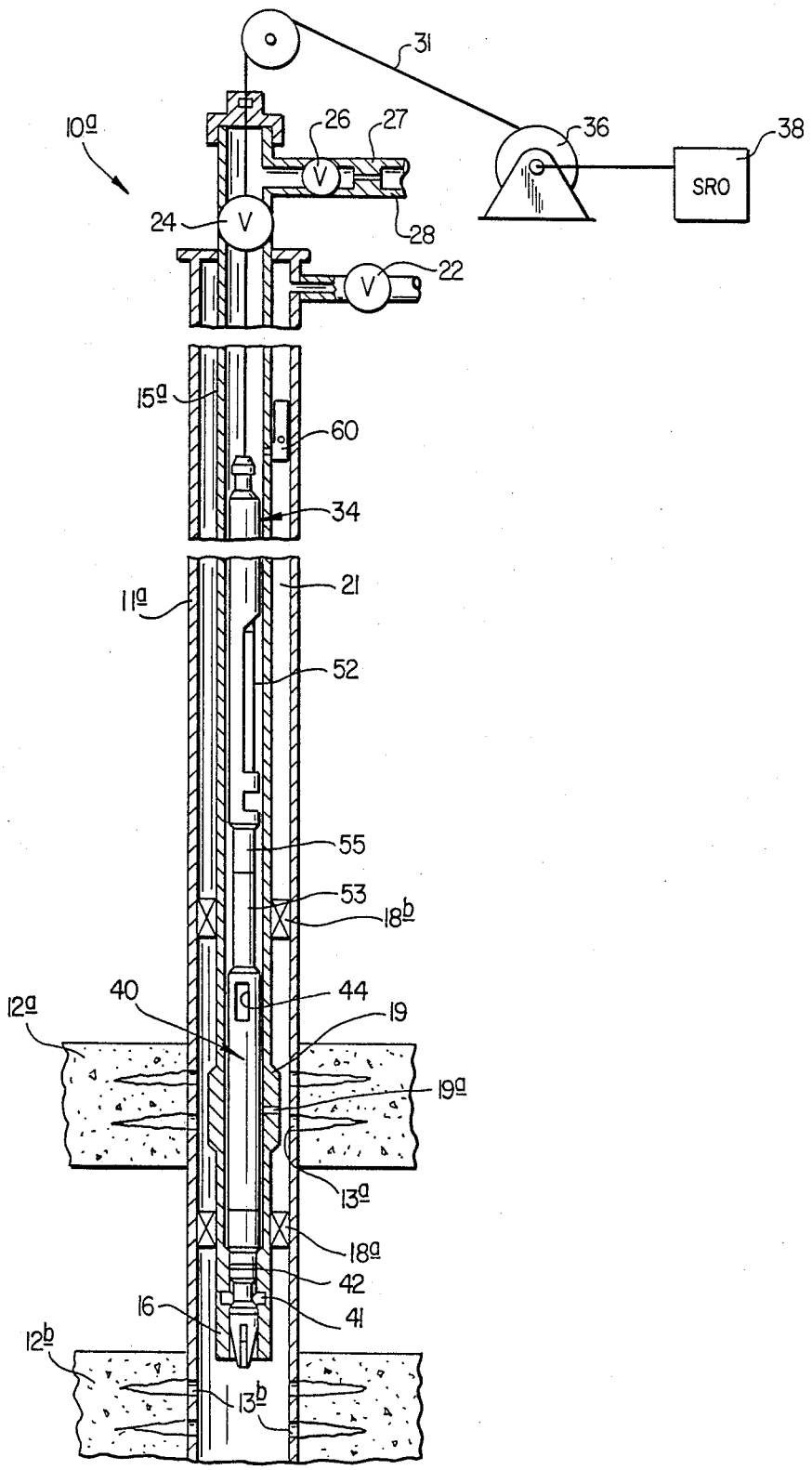
FIG. 2 is a schematical view similar to FIG. 1 but showing a two-zone well undergoing testing.

Referring now to FIG. 2, it will be seen that the well **10*a* is provided with well casing 11*a* which extends from the surface down through an upper formation 12*a* and into a lower producing formation 12*b*. The casing 11*a* is perforated as at 13*a* to provide communication between the producing formation 12*a* and the interior of the casing 11*a* while the casing is additionally perforated as at 13*b* to provide communication between the producing formation 12*b* and the interior of the casing. A string of well tubing 15*a* is disposed in the casing and has a landing receptacle 16 at its lower end although the landing receptacle could be, within limits, located even above the packer 18*a* which seals between the tubing and the casing at a location between the producing zones 12***a* and 12*b*. The tubing is further provided with a suitable device 19 providing a lateral flow port 19*a* located preferably near the perforations 13*a* of the upper producing formation 12*a*.

In addition, a second packer 18*b* may be desirable for sealing between the tubing and the casing at a location above and preferably near the upper producing formation 12*a*, especially if gas lifting will be necessary, in which case one or more gas lift valves, such as gas lift valve 60, will be needed. This upper packer 18*b* isolates the upper portion of the tubing casing annulus 21 from the producing zones therebelow. Normally a well may require only three to seven but sometimes as any as ten or more gas lift valves. Gas lift valves are spaced along the tubing string at depths selected according to good gas lift engineering practices taking into consideration the available lift gas pressure, the working fluid level of the well, the shut-in fluid level of the well, the bottom-hole pressure, productivity index, the amount of water produced, the amount of oil produced, the gravity of the oil, the amount of gas, the gravity of the lift gas, the well temperatures, and maybe some other factors.

Lift gas for powering the gas lift operation would be introduced into the well annulus 21 through the wing valve 22 on the casing, the gas would enter the proper gas lift valve and would aerate the column of well fluids in the tubing to decrease the density thereof so that the well fluids could be lifted to the surface through the tubing to be produced through the master valve 24, the wing valve 26, and the surface choke 27, into the flow line 28. The surface choke 27 may or may not be required.

In performing well testing operations on the well 10*a* a tool train or transducer probe 34 which may be exactly like the tool string 34 of FIG. 1 is lowered into the well on the electric cable 31 and its valve section 40 landed in the receptacle 16 so that it is latched therein by the lugs 41 and sealed by the seal 42 so that well fluids flow upwardly through the tubing as controlled by the valve 40. The valve 40 is operable between open and closed positions from the surface by tensioning or relaxing the cable 31. When the valve is open the lower formation 12*b* can produce upwardly through the tubing, the well fluids flowing through the valve 40 and exiting the valve through the window 44.

The pressure gages 52 and 53 are exactly like the pressure gages of the tool string of FIG. 1.

During testing of the well both the upper and lower production zones 12*a* and 12*b* may be allowed to flow through the tubing and to stabilize. The lower zone produces upwardly through the valve 40 which is engaged in the landing receptacle 16 while production fluids from the upper zone 12*a* enter the well casing through perforations 13*a* and flow through lateral flow port 19*a* in device 19 into the tubing to their mix with the production fluids from the lower zone. The mixture of the upper and lower production fluids then advances to the surface in the usual manner. In some cases this fluid flow may be assisted by gas lifting utilizing gas lift valves, such as the gas lift valve 60. In the gas lift operation lift gas is introduced into the tubing-casing annulus 21 at the surface through valve 22 and this lift gas advances downwardly in the annulus to one or more gas lift valves. The gas lift valves control the entry of lift gas from the tubing-casing annulus into the tubing so that the well production fluids in the tubing will be properly aerated to reduce their density so that they may be lifted to the surface as explained hereinabove.

So long as the master valve 24, the wing valve 26, and the downhole test valve 40 are open both of the production zones may be produced through the tubing, it being understood that if gas lift is necessary then this production would require also the introduction of lift gas into the annulus through the casing wing valve 22.

The valve 40 is held open by maintaining the electric cable 31 in a slack condition in which case the production fluids from the lower zone 12*b* pass upwardly through the valve and exit through the window 44 into the tubing.

When the electric cable 31 is tensioned the valve 40 will be moved to its closed position and no flow can take place therethrough. The valve 40 being shut, production fluids from the lower formation 12*b* will continue to enter the well bore through perforations 13*b* and the pressure in the well below the packer 18*a* will build up until this pressure stabilizes with the formation pressure. All the while, whether the valve 40 is open or shut, the lower pressure gage 53 is continually monitoring the pressure below the valve 40. At the same time the upper pressure gage 52 is monitoring the pressure in the well tubing near the level of the upper zone 12*a*. In the schematic view of FIG. 2, which is not a scale drawing, the upper end of the tool string is shown to be far above the packer 18*b* which is above the upper formation 12*a*. Such would not be the case in reality. Normally the lower packer 18*a* would be between the two production zones and probably near the lower production zone. The upper packer 18*b* would be above the upper production zone and probably quite near it. The upper production zone may be from a few feet to a hundred or more feet above the lower production zone. The landing receptacle 16 may be at the lower end of the tubing as shown, and therefore below the lower packer 18*a* and next to or on a level with the lower production zone, but the landing receptacle could be somewhat above the lower packer if desired or necessary. With the test tool string 34 having its valve 40 engaged in the landing receptacle 16, the upper pressure gage would likely be located at a level near and very likely a little below the upper producing formation, the distance from the landing receptacle to the upper pressure gage 52 would in many cases reasonably be approximately ten to fifteen feet (approximately 3–4.6 meters).

All the while that the valve 40 is closed and pressure is building therebelow the lower pressure gage, in its turn, sends signals to the surface to be processed for display and/or recording. At the same time the upper pressure gage, in its turn, sends its signals to the surface for processing. It may be however, that the information sent to the surface by the upper pressure gage 52 at this time may be of little or no interest, the principal interest being the build-up of the pressure below the closed valve 40. On the other hand, information regarding the flowing pressures of the upper producing zone 12*a* may be obtained while the valve 40 is closed and pressure is building therebelow.

It is often desired to test the upper formation 12*a* while the lower formation 12*b* is closed in. Since the normal operation of a well of this type may be to flow the upper and lower zones simultaneously through the tubing, as previously described, merely flowing the well on the upper production formation 12*a* may not supply information of great value. It may be more desirable in some cases to provide a surface choke 27 of suitable orifice to cause the upper production zone 12a to produce during this time at a rate which would equal the rate of flow for the upper zone during the time when it normally flows simultaneously with the lower production zone. Then, with such surface choke of proper orifice in the position of choke 27, the upper zone 12a is placed on production and allowed to stabilize while pressures thereof are being sensed by the upper pressure gage 52. After such flowing, the wing valve 26 is closed to stop production of the upper zone while the build-up of upper zone pressures in the region of upper pressure gage 52 are monitored. Thus, both upper and lower pressure zones 12a and 12b may be tested by providing periods during which each zone is closed in and also opened to flow, the lower pressure gage monitoring the pressures of the lower zone and the upper pressure gage monitoring the pressures of the upper zone.

The temperature sensor 55 located immediately above the lower pressure gage 53 all the while sends its signals corresponding to the temperatures sensed thereby to the surface via the cable 31 at the same time that signals are sent from the lower pressure gage 53 to the surface. As was stated before the temperature information may or may not be of value to those who are to evaluate the test information, however the temperature information is used to correct the pressure readings for temperature so that accurate pressure information will be displayed and/or recorded for study. As we stated before the temperature information is fed into the computer and the software automatically applies correction factors so that the correct pressures will appear on the printout.

It is now readily understood that a method is practiced in carrying out well test operations on a well such as that shown in FIG. 2. This method involves steps of lowering the tool string which includes a valve having locking and sealing means thereon and being connected to upper and lower electronic pressure gages, into the well on an electrical conductor cable, the upper end of the cable being connected to surface readout equipment, engaging the lock in the landing receptacle in the well, determining the pressure conditions below the valve at all times with one of the pressure gages, determining the pressure conditions above the valve with the other pressure gage, sending signals to the surface from each of the pressure gages in turn corresponding to the pressures sensed thereby, and processing the signals received at the surface through use of the surface readout equipment so that the pressure information both above and below the valve may be displayed and/or recorded.

Figure 3:
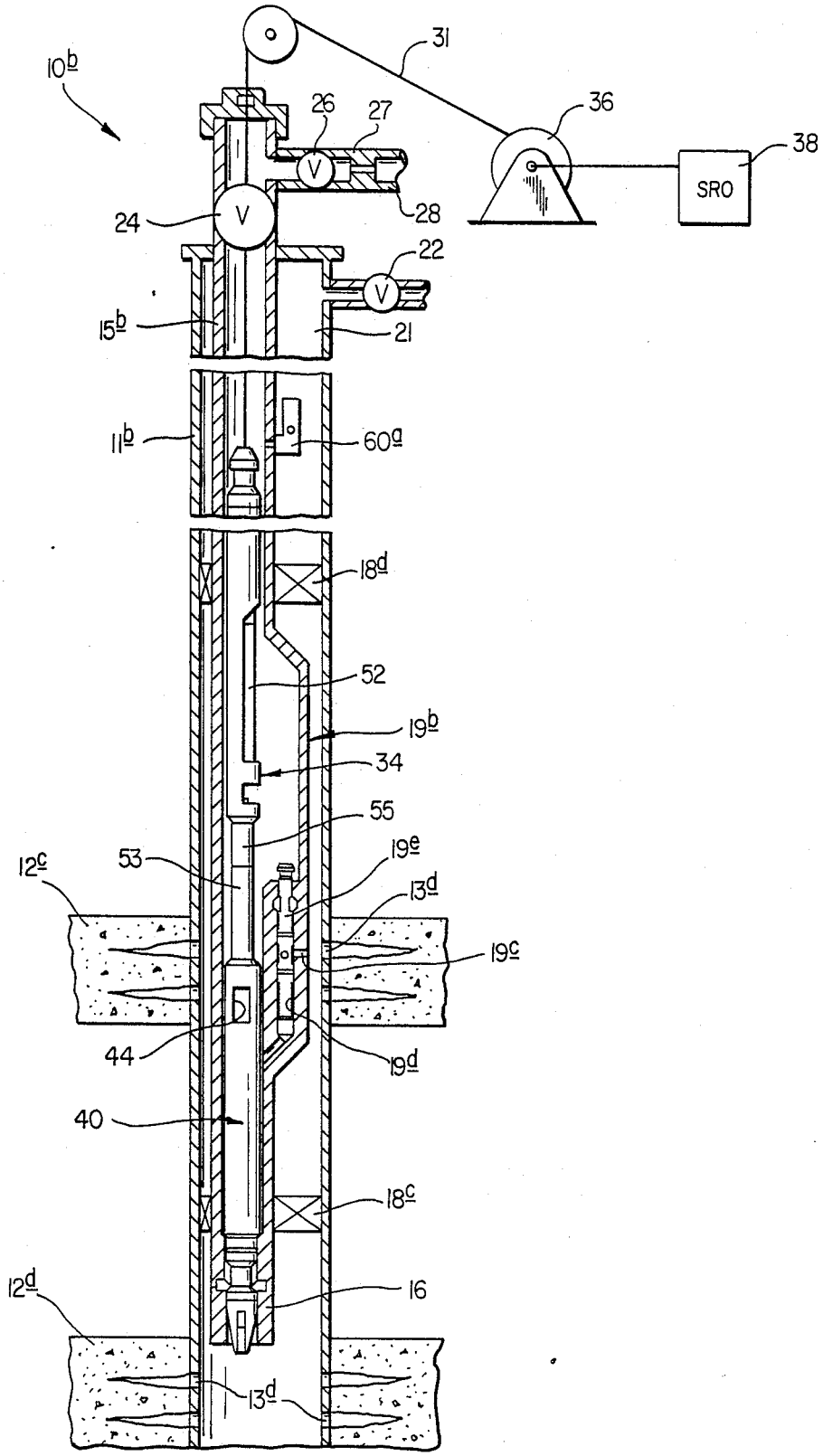
FIG. 3 is a schematical view showing a two-zone well similar to that of FIG. 3, but having a side pocket mandrel in the tubing string opposite the upper zone.

Referring now to FIG. 3, it will be seen that a well 10b is schematically illustrated and that it is very similar to the well FIG. 2. Well 10b is provided with a casing 11b which passes through upper producing formation 12c and into or through a lower producing formation 12d, as shown. The casing 11b is perforated as at 13c in the upper zone and as at 13d in the lower zone. A well tubing string 15b is disposed in the casing and a packer 18c seals between the tubing and the casing at a location between the two production zones 12c and 12d. The lower end of the tubing is open to the lower production zone as shown and a landing receptacle 16 is provided at the lower end of the well tubing. This landing receptacle could be located above the lower end of the tubing and even above the packer 18c, but is preferably located near the packer 18c. Above upper producing zone 12c, packer 18d seals between the tubing and the casing.

The tubing is provided with a lateral flow port 19c which serves the same purpose as the flow ports 19 and 19a in the wells 10 and 10a of FIGS. 1 and 2, respectively. In the case of well 10b, however, the lateral flow port 19c is provided by a side pocket mandrel 19b which may be of any suitable type. The side pocket mandrel 19b is provided with a receptacle 19d in which a flow control device 19e is disposed for controlling flow through the lateral flow port 19c. In the type of well shown in FIG. 3 the flow control device 19e would possibly contain a flow choke of suitable orifice size. The flow control device 19e also serves to protect the locking and sealing surfaces in receptacle 19d against damage by flow cutting action should the flow control device 19e not be present.

The tubing is further provided with one or more gas lift valves 60a which utilize lift gas introduced into the tubing-casing annulus 21 through the casing wing valve 22 for gas lift operations in which the lift gas is introduced from the annulus 21 into the tubing through the gas lift valve 60a in the well-known manner, the gas lift valves being spaced apart and from the surface and from each other according to good gas lift practice as before mentioned.

Normally, the well 10b would be produced with both the upper and lower zones 12c and 12d flowing through the tubing in the same manner as was explained with respect to the well 10a of FIG. 2, the only difference being that the lateral flow port 19c of well 10b is provided by a side pocket mandrel and that a flow control device 19e is installed in the side pocket mandrel whereas the lateral port 19a in the well 10a of FIG. 2 is provided by a special device such as a ported nipple. The port 19a, however, could be provided by a sliding sleeve valve, or merely a preparation in the tubing. The methods of testing this well using the test equipment of the present invention are exactly the same as in the case of the well of FIG. 2.

The test tool string which embodies one aspect of this invention is illustrated in FIGS. 4A–4F where it is indicated generally by the reference numeral 100. The tool string 100 is connected to the lower end of a single conductor electric cable 102 which has its upper end connected to the surface readout equipment 38 seen in FIGS. 1–3. The single conductor 104 is surrounded by suitable insulation 105 and the insulation is surrounded by suitable armor. The armor comprises an inner layer of high tensile wires 106 which are wound helically around the insulation 105 while an outer layer of high tensile wires 107 likewise is wound helically about the inner layer of wires 106 but in the opposite direction, as shown. The single conductor wire 104 is of a suitable conducting material such as copper and conducts the electrical power required to operate the instruments of the tool string from the power source at the surface down to the tool string. The armor provides the return path for the electricity.

The electric cable 102 is connected to the tool string 100 in the well-known manner. The armor of electric cable 102 is connected directly to the rope jacket 110 at the extreme upper end of the tool string while the central conductor wire 104 is electrically connected to the electrical system inside the tool string and from that connection a suitable insulated conductor wire (not shown) extends downwardly through the weight bar 112 to the electrical circuits therebelow.

Figure 5:
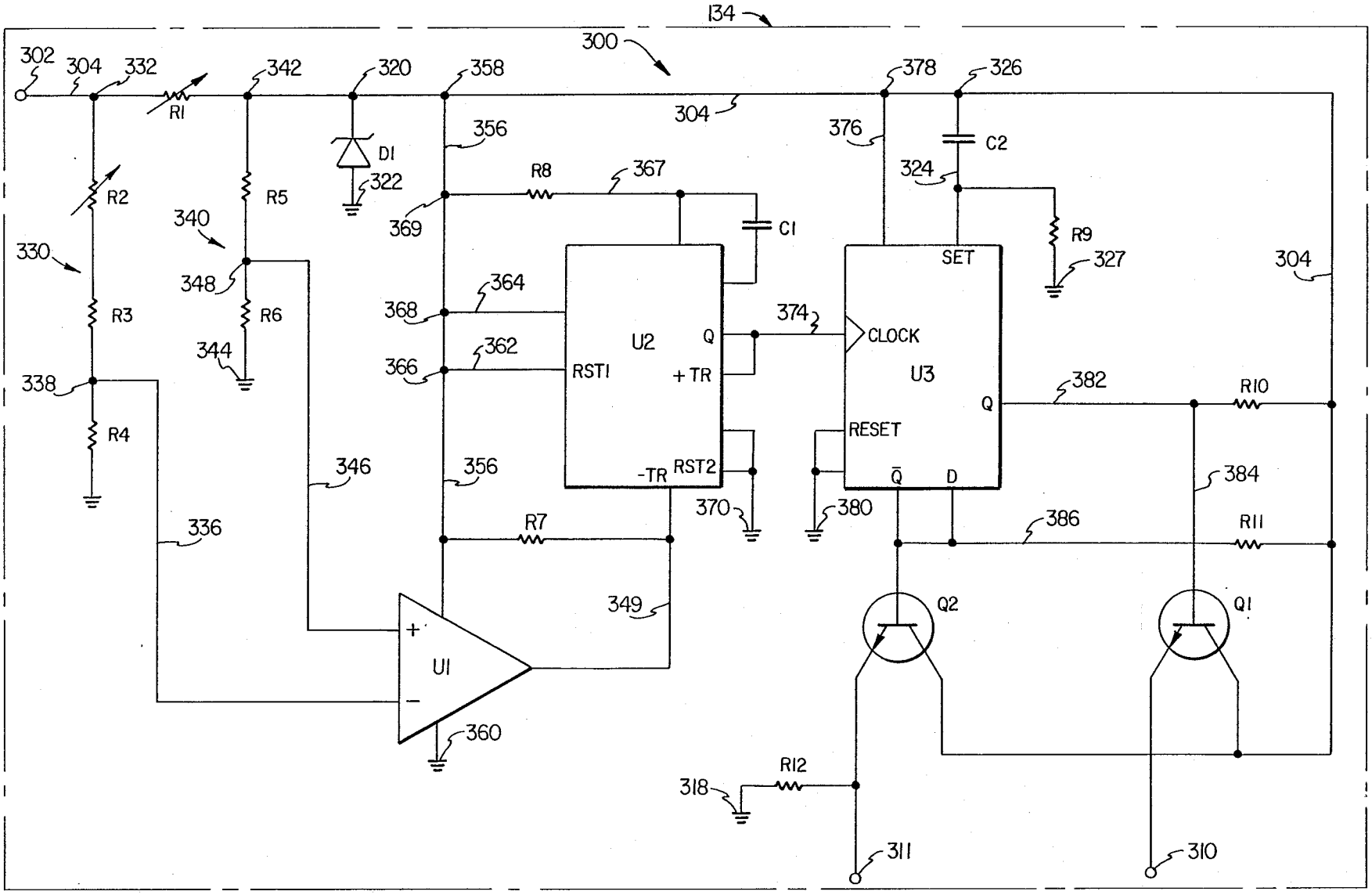
FIG. 5 is a diagrammatical view of the circuitry of the electronic toggle switch used in the test tool string of FIGS. 4A–4F to control the two pressure gages carried thereby.

Immediately below the rope socket is the weight bar 112 which may be about five to seven feet long, and if necessary more than one may be used. The weight bar is threadedly connected as at 114 to the upper end of the bypass tool 130 as shown. The weight bar has a small central bore 116 therethrough to accommodate the small internal wire (not shown) which will conduct power to electrical components therebelow. The small conductor wire is connected to spring loaded connection 120 in the lower end of the weight bar 112 and this spring loaded connection makes contact with a suitable connector member 122 which is disposed in the upper end of the bypass tool 130 as shown. A short wire 132 has its upper end connected to connector member 122 and has its lower end connected to a circuit board 134. The circuit board is grounded to switch housing 135 as at 137. Circuit board 134 has electronic components (not shown) thereon comprising an electronic toggle switch, the diagram which is shown in FIG. 5 and which will be explained later. A pair of electrical conductor wires 136 and 138 extend downwardly from the lower end of the circuit board 134, wire 136 having its lower end electrically connected to the central screw 140 therebelow and the other wire 138 having its lower end passing through a bypass tube 142 which is disposed longitudinally near the periphery of the bypass housing 144 whose upper end telescopes over the lower reduced portion 145 of the toggle switch housing 135 and is secured in place by suitable screws 146. This bypass tool is similar to that illustrated and described in U.S. Pat. No. 4,568,933.

Electrical power is conducted downwardly through the screw 140 to a suitable electrical connection which makes contact with the upper end of a suitable upper pressure gage such as, for instance, the Hewlett-Packard pressure gage 150 threadedly connected as at 152 to the lower end of the toggle switch housing 135.

The bypass body 144 is cut away to form a large window 146 into which the gage 150 can be placed so that the thread 152 can be made up and tightened. For this operation the gage 150 is placed with its lower end into the window and lowered into the housing 144 until the threaded connection at the upper end thereof may be mated with the threaded connection in the upper end of the toggle switch body. After the threaded connection 152 has been tightened the lower end of the gage 150 is below the lower end of the window 146 where it is protected.

A second window 156 is formed in the bypass body below the large window 146 to provide access to the lower end of the bypass tube 142 so that its connection means 158 may be tightened. The bypass tube is disposed in a slot 143 in the bypass housing and just below the lower end of the gage 150 the bypass tube is bent as shown so that its lower end may be disposed concentrically relative to the instrument so that the connection 158 may be made with ease.

The electrical conductor wire 138 has its lower end connected to a screw 160 which forms a part of an electrical connection having a spring loaded plunger 162 at its lower end. This spring loaded plunger 162 makes electrical contact with a suitable connector member 163 which forms a part of a temperature sensing tool 165 threadedly connected as at 167 to the lower end of the sub 169 forming the lower portion of the bypass body 144 of the bypass tool 130 and having its reduced upper end telescoped into the lower end of bypass body 144 where it is secured by screws 146.

A wire 172 has its upper end electrically connected to the connector 163 while its lower end is electrically connected to the circuit board 175 disposed inside the housing 176 of the temperature sensing tool 165, and is grounded as at 177, the circuit board 175 having thereon electrical components (not shown) for operating the electronic sensing means 165.

An electric conductor wire 180 connected to the lower end of the circuit board 175 has its lower end electrically connected to a connector member 182 which transmits electrical power or signals to or from a mating connecting member 183 for conducting power down to the lower pressure gage 190 therebelow are conducting signals upward therepast. The lower pressure gage 190 is preferably exactly like the upper pressure gage 150 previously mentioned with the exception that its lower portion has been replaced by a suitable adapter by which the pressure gage 190 is connected to the well test tool 220 suspended therebelow.

The test tool 220 and the landing receptacle 16 therefor (not shown in FIG. 4F) is preferably like or similar to the test tool illustrated and described in U.S. Pat. No. 4,487,261, supra. The test tool 220 is adapted for landing in a landing receptacle such as the landing receptacle 16 illustrated in conjunction with well 10, **10*a*, and 10*b* and is provided with a seal 222 for sealing with such landing receptacle and with an external annular recess 224 providing an upwardly facing shoulder 225 for co-acting with the lugs 41 of the landing receptacle to retain the test tool in proper position for test operations. The test tool 220 further has an internal wave therein, which may be like that shown and described in U.S. Pat. No. 4,487,261, and having an inlet slot or port at the lower end as at 228, its outlet being the window 230 spaced above the seal 222. The valve (not shown) is operable between open and closed positions by tensioning and slacking the electric cable as before explained. When the valve in the test tool is open, well fluids may enter the test tool through the entrance ports or slots 228 and more upwardly through the test tool to exit through the window 230 above seal 222**. When the valve of the test tool is closed well fluids are prevented from flowing therethrough.

Whether the valve in the test tool is open or closed, a passageway (not shown) is provided which bypasses the valve and communicates pressure from below the seal 222 to the lower pressure gage 190. Thus, well pressure below the valve is communicated at all times to the pressure gage 190. .

In operation the test tool string 100 is lowered into the well on the electric cable 102 while the upper end of the cable is connected electrically to the surface readout equipment 38 and, if it is desired, to read well pressures at the various levels in the well as the tool is lowered into the well tubing, the tool string is stopped at such desired levels and the magnitude of the pressures thereat determined. It may be necessary to wait a few minutes each time to allow the temperature of the gage to stabilize with the well temperature at that level. Since the pressure gages are connected to the surface readout the CRT may be watched as the tool string is lowered into the well and it may be readily determined from such observation whether the instruments in the tool string are functioning properly.

It is possible that the well may be allowed to flow as the instruments are being lowered into the well. If so, the tool string may be stopped just above the landing receptacle 16 and the flowing pressures observed for a suitable time. The tool string is then lowered and the test tool 220 is inserted into the landing receptacle so that the seal 222 thereon seals with the landing receptacle and the lugs of the landing receptacle engage the external annular recess 224 near the lower end of the test tool. This will latch and seal and test tool in the receptacle. As the test tool is forced into the landing receptacle the valve in the test tool will be open and will remain open so long as the cable is somewhat slackened. After the test tool is landed in the receptacle the electric cable 102 may be tensioned to close the valve, shutting off all flow through the landing receptacle. Immediately the pressure below the receptacle begins to build up as well fluids continue to enter the well bore through the perforations but cannot move upwardly beyond the landing receptacle or the packer. Since the lower pressure gage 190 is in constant communication with the producing zone below the test tool, the build-up of pressures below the packer will be displayed and/or recorded at the surface as the lower pressure gage samples the pressures and sends appropriate signals to the surface.

While the lower zone is thus shut in by the closed valve in the landing receptacle the upper zone of a two-zone well may be flowed so that the pressures thereof in the well bore may be sensed by the upper gage so that information relating thereto may be gathered. After flowing the upper formation it can be shut in by closing the wing valve on the Christmas tree at the surface and the pressures in the tubing built up as the formation fluids enter the tubing but cannot be discharged at the surface due to the closed wing valve. The upper pressure gage will continue to sample the pressures near the upper formation and continue to send appropriate signals to the surface readout equipment for processing for display and/or recording of such pressure information.

After the testing of the well has been completed the valve in the test tool 220 may be opened by slacking the electric cable 102 and after the pressures have equalized across the test tool it may be removed in the manner taught in U.S. Pat. No. 4,487,261 and the entire tool string withdrawn from the well.

Referring now to FIG. 5, it will be seen that the circuit board 134 of bypass tool 130 is indicated by the rectangle represented by the broken line and that the circuit shown in the diagram is that of the electronic toggle switch. This circuit is indicated generally by the reference numeral 300.

The circuit 300 has its input terminal 302 connected to the lower end of the conductor wire 132 (see FIG. 4D) for receiving electric power from the surface readout equipment 38 when it is turned on. Electric power is conducted from terminal 302 through conductor 304 which leads to output terminals 310 and 311 to which the lower pressure gage 53 and the upper pressure gage 52 are electrically connected. It is seen that this electric power must pass through resistor R1 and one of the npn transistors Q1 or Q2. If transistor Q1 is on, power will flow through it to terminal 310 and on to the lower pressure gage 53 connected thereto. If transistor Q2 is on, power will flow therethrough to terminal 311 and on to the upper pressure gage 52 connected thereto. The function of toggle switch circuit 300 is to control the transistors Q1 and Q2 by turning only one of them on at a time and to do so alternately. When the circuit 300 receives power, as when the power switch is turned on at the surface, the circuitry will always turn on a particular one of the transistors first. For convenience, the circuitry is arranged to always turn on transistor Q1 first. The purpose for this will come to light later. (Resistor R1 preferably adjustable, as shown, for a purpose to be explained later.)

When the electric power is first applied to terminal 302, current flows via conductor 304 to terminal 310, passing through transistor Q1. When the power is first turned on, the current will be directed to terminal 310 first, because as was earlier explained, the circuitry is designed to begin with transistor Q1 to be turned on initially. The control of transistors Q1 and Q2 is accomplished by a flip-flop U3 which at first turns on transistor Q1 to furnish power to terminal 310 and, thus, to the lower pressure gage 53 electrically connected thereto. Then it turns transistor Q1 off and immediately turns on transistor Q2 to supply power to terminal 311 and, thus, to the upper pressure gage 52 electrically connected thereto. This toggling between transistors Q1 and Q2 occurs in response to a pulse received by the flip-flop U3 from one-shot U2. (The flip-flop may be an RCA CD4013, or Motorola MC14013B.) Thus, each time that the one shot U2 sends a pulse to flip-flop U3, the flip-flop will turn off whichever transistor (Q1 or Q2) is on and turn on the other one.

The one-shot U2 sends an electrical pulse to the flip-flop U3 in response to an electrical pulse received from a comparator U1, and the comparator U1 sends out such electrical pulse as a result of an electrical pulse sent down the electric cable 102 from the surface and received by terminal 302, all in a manner to be explained. (The one-shot U2 is a monostable multivibrator such as that known as a CD 4098B).

The two pressure gages 52 and 53 are alike, except for the way they are connected into the test tool string. Each pressure gage requires a constant electrical current of 14 milliamps at 12 volts. Since it is usual practice to use a temperature gage such as temperature gage 165 in the test tool string so that, at least, the pressure gage readings can be corrected for temperature, and since the temperature gage requires a constant current of 7 milliamps at 12 volts, a constant current of 21 milliamps at 12 volts will be required at terminal 310, the temperature gage 165 and the lower pressure gage being supplied power from that terminal.

Thus, a current of 21 milliamps at 12 volts is required at terminal 310 to operate pressure gage 53 (14 milliamps) plus the temperature gage (7 milliamps), while the pressure gage 52 requires only 14 milliamps at terminal 311, there being no temperature gage connected to terminal 311 with pressure gage 52. This problem resulting from the imbalance of 7 milliamps in the current requirements at terminals 310 and 311 is readily overcome by adding a 1.7k ohm resistor, indicated by the reference numeral R12, between transistor Q2 and terminal 311 and grounding the same as at 318. Thus, transistors Q1 and Q2 will each pass a constant current 21 milliamps at 12 volts when they are turned on in turn. When transistor Q2 is passing 21 milliamps of current, the pressure gage 52 will consume 14 milliamps and the resistor will pass 7 milliamps to ground. In either case, the 21 milliamps of current will return to the surface through the armor wires 106 and 107 of the electric cable 102 which, like the circuit board 134, is grounded to the test tool string.

Should the temperature gage 165 not be used, then resistor R12 can be eliminated and the constant current reduced to 14 milliamps at 12 volts. If, on the other hand, the temperature gage is connected with pressure gage 52 to terminal 311, then the resistor R12 should be connected between terminal 310 and transistor Q1 and grounded. Thus, when the temperature gage is connected with one of the pressure gages, a resistor such as resistor R12 should be used with the other pressure gage to balance the load requirements and thus avoid the problem of changing the amperage of the current back and forth each time current is switched from one of the transistors to the other.

A voltage potential force of 12 volts is required beyond resistor R1 because this is the voltage required by the pressure gages 52 and 53, and by the temperature gage 165. The value of resistor R1 in this case is adjusted to substantially 30 ohms, thus, with a current of 21 milliamps, the voltage at terminal must be substantially 12.6 volts.

A spaced distance beyond resistor R1 from terminal 302, a Zener diode D1 is connected as at 320 to conductor 304 and is grounded as at 322, as shown.

A spaced distance beyond the Zener diode connection 320 a conductor 324 is connected as at 326 to conductor 304 and its other end is connected to the "set" pin of the flip-flop U3, as shown. Conductor 324 has a capacitor C2 connected in it as shown while a resistor R9 having, in this case, a value of 1M ohms is connected into conductor 324 between the capacitor C2 and flip-flop U3 and is grounded as at 327. When power is turned on and reaches the toggle switch circuit 300, conductor 324 immediately sets the flip-flop so that the voltage at pin Q is high, in which condition transistor Q1 will be turned on. In this manner, on power up, the circuit is always initialized such that transistor Q1 is turned on first.

A first voltage divider 330 comprising resistor R2 (68k ohms), resistor R3 (220k ohms), and resistor R4 (220k ohms) is connected to conductor 304 as at 332 between terminal 302 and resistor R1 and is grounded as at 334. A conductor 336 has one end thereof connected as at 338 between resistors R3 and R4, while its other end is connected to the negative input of comparator U1, as shown. Comparator U1 may be that known as an LM 399N.

A second voltage divider 340 comprising resistor R5 (220k ohms) and resistor R6 (220k ohms) is connected to conductor 304 as at 342 and is grounded as at 344. A conductor 346 has one end thereof connected between resistors R5 and R6 as at 348 and has its opposite end connected to the positive input of comparator, as shown.

(Resistor R2 like resistor R1 is preferably adjustable as shown for a purpose which will be explained later.)

In operation, the voltage at connection 332 is reduced by the voltage divider 300 from the 12.6 volts mentioned earlier to a value of 5.5 volts at the negative input of comparator U1. At the same time, the voltage at connection 342 is reduced by voltage divider 340 from 12 volts to a value of 6 volts at the positive input of comparator U1. In this condition of the test tool string, the power is on, transistor Q1 is on, the pressure gage 53 is sensing well pressure transmitted to it from the lower end of the test tool string and generating signals corresponding to the pressures sensed and sending them to the surface through the terminal 310, conductor 304 including transistor Q1 and resistor R1, to terminal 302 and through conductor wire 104 of electric cable 102, to the surface for processing and display and/or recording. During this time, the comparator U1, one-shot U2, and flip-flop U4 are inactive.

The toggle switch 300 is caused to toggle and, thus, to cause transistor Q1 to be turned off and transistor Q2 to be turned on in a manner which will now be explained.

The supply current at input terminal 302, which to now has been 21 milliamps, is momentarily raised to a somewhat higher value, say to 75 milliamps at 15.25 volts for a duration of 10 to 100 milliseconds. The voltage beyond resistor R1 rises until Zener diode D1 turns on at 13 volts and limits the voltage difference across voltage divider 340 (resistors R5 and R6) to 13 volts. The currenct flowing through resistor R1 is, at this brief time, 75 milliamps and the voltage at terminal 302 and at connection 332 is at 15.25 volts.

The first voltage divider 330 reduces the 15.25 volts to a value of 6.6 volts reaching the comparator U1 through conductor 336. Thus, the voltage in conductor 336 and reaching the comparator U1 has been increased from 5.5 to 6.6 volts. At the same time, the 13 volts reaching the second voltage divider is reduced thereby to a value of 6.5 volts which reaches the comparator through conductor 346. Thus, the voltage in conductor 346 has been increased from 6 volts to 6.5 volts. Now, whereas the voltage at the positive input of comparator U1 previously was higher than that at the negative input of the comparator by 0.5 volt (6 volts compared with 5.5 volts), the voltage at the negative input of the comparator now is higher than the positive input by 0.1 volt (6.6 volts as compared with 6.5 volts). This sudden change in conditions at comparator U1 (its positive input becoming negative whereas it was previously positive) causes the output of comparator U1 at conductor 346 to become negative, and when this negative-going transition (transmitted through conductor 349) reaches the −TR input of the one-shot U2 it triggers the one-shot.

The comparator U1 receives power from conductor 304 through conductor 356 connected thereto as at connection 358. Comparator U1 is grounded as at 360. One-shot U2 receives power from conductor 356 through conductors 362 and 364 connected thereto as at 366 and 368, respectively. One-shot U2 is grounded as at 370.

When the one-shot U2 is triggered, it generates a far more suitable and reliable electrical pulse and sends it through conductor 374 to the flip-flop U3 to trigger the same causing it to toggle. This pulse generated by the one-shot U2 is preferably of approximately 500 milliseconds duration and is free of ringing or noise, or the like disturbance, which could be present at the output of comparator U1 due to backlash effects resulting from the discharge of electrical energy from the electric cable at the end of the 75 milliamp pulse.

The resistor R8 and the capacitor C-1 are provided in conductor 367 connected to conductor 356 as at 369 and to the one-shot U2 as shown to control the duration of the pulse generated by the one-shot, in this case 500 miliseconds.

Since the output pulse of one-shot U2 is of approximately 500 milliseconds duration, the input pulse received thereby must be of significantly lesser duration in comparison in order to prevent undesired double triggering of the one-shot.

The flip-flop U3 as before explained is initially placed in its beginning state, in which transistor Q1 is on, when toggle circuit 300 first receives power. The flip-flop receives electrical power from conductor 304 through conductor 376 connected thereto as at 378, and is grounded as at 380.

Flip-flop U3 is triggered and changes state each time that it receives the 500-millisecond pulse from the one-shot U2. In the initial state, power is transmitted from output Q of the flip-flop through conduits 382 and 384 to the base of transistor Q1, applying a bias thereto to turn it on so that power may flow through conductor 304 and through the transistor Q1 to terminal 310 to furnish power to the lower pressure gage 190 and the temperature gage 165 connected thereto.

When flip-flop U3 next receives a 500-millisecond pulse from one-shot U2, it is triggered and caused to toggle again. This time triggering causes transistor Q1 to be turned off as electrical power ceases to flow from the Q output and transistor Q2 to be turned on as electrical power flows from the $\overline{Q}$ output of flip-flop U3. This action switches power from terminal 310 to 311 so that upper pressure gage 150 will now be powered. Upon receiving of the next 500 millisecond pulse, the flip-flop will be triggered again and caused to toggle, turning off transistor Q2 and turning on transistor Q1. Thus, with each such pulse received the flip-flop changes state and remains in such state until the next pulse is received to caus another toggling.

Resistor R10 is provided in conductor 382 at a location between conductors 304 and 384 to aid in proper operation of transistor Q1 as a switch. In like manner, resistor R11 is provided in conductor 386 to aid in proper operation of transistor Q2.

When transistor Q1 is on, electrical current of 21 milliamps at 12 volts flows through conductor 304 and through transistor Q1 to the lower pressure gage 190 and the temperature gage 165 and these two instruments generate electrical signals corresponding to the pressures and temperatures sensed thereby and these signals are transmitted simultaneously up through terminal 310 and conductor 304 to terminal 302, then to the surface through conductor 104 in the center of electric cable 102. Similarly, when transistor Q2 is on, upper pressure gage 150 generates signals corresponding to the pressures sensed thereby and such signals are transmitted to the surface via terminal 311, transistor Q2, conduit 304, terminal 302 and cable conductor 104.

The signals received at the surface readout equipment 38 from the lower pressure gage 190 are accompanied by the signals from the temperature gage 165 and so are distinguishable from the signals sent up by the upper pressure gage 150 which arrive unaccompanied by any other signal. Thus, the two pressure gages have distinguishable signatures. Should, at any time, a question arise concerning which instrument is sampling at a given time, it is needful only to turn off the power and then turn it on again. The flip-flop U3 will always turn on transistor Q1 first. Thus, in the example at hand, the lower pressure gage is first to send signals to the surface for processing.

The frequency of toggling of flip-flop U3 is controlled from the surface since toggling thereof results indirectly from the 75 milliamp pulse sent down the electric cable from the surface. Thus, the surface readout equipment includes means for generating these 75 milliamp pulses and to generate them at desired intervals. Generally such pulses are generated about every 10 seconds, but could be generated at almost any desired frequency. To insure proper operation of the test equipment, it may be desirable to not trigger the flip-flop more frequently, than about every 3 seconds.

It is to be noted that resistors R1 and R2 are adjustable (as indicated by the arrow superimposed upon each one). Thus, the value of these resistors may be adjusted for establishing the sensitivity of the triggering of comparator U1.

The surface readout equipment is illustrated schematically in FIG. 6 where it is indicated generally by the reference numeral 400.

Surface readout equipment 400 comprises a computer 410, a counter 415, a signal processor 420, a VHF switch 425, and an adjustable power supply 430, all of which operate on suitable current, such as 115 volts A.C., or in some case 230 volts A.C., the source of which is not shown. This surface readout equipment would normally be carried on a service truck, or the likef (not shown), which would also carry means for providing the current needed by the components listed above.

Computer 410 is provided with a printer 435 and a cathode ray tube (CRT) 440 connected thereto and controlled thereby while the computer 410 is controlled by suitable software, all in the well-known manner.

Computer 410, counter 415, and VHF switch 425 are connected together or interfaced by a suitable interface bus 445. The computer 410, counter 415, and VHF switch 425, as well as the interface bus, are preferably items purchased under the name Hewlett-Packard. Of course, many suitable computers and related components are available on the market. The printer 435 and CRT 440 may be Hewlett-Packard items but could be of any brand which will interface properly with the Hewlett-Packard computer 410.

Figure 4A:
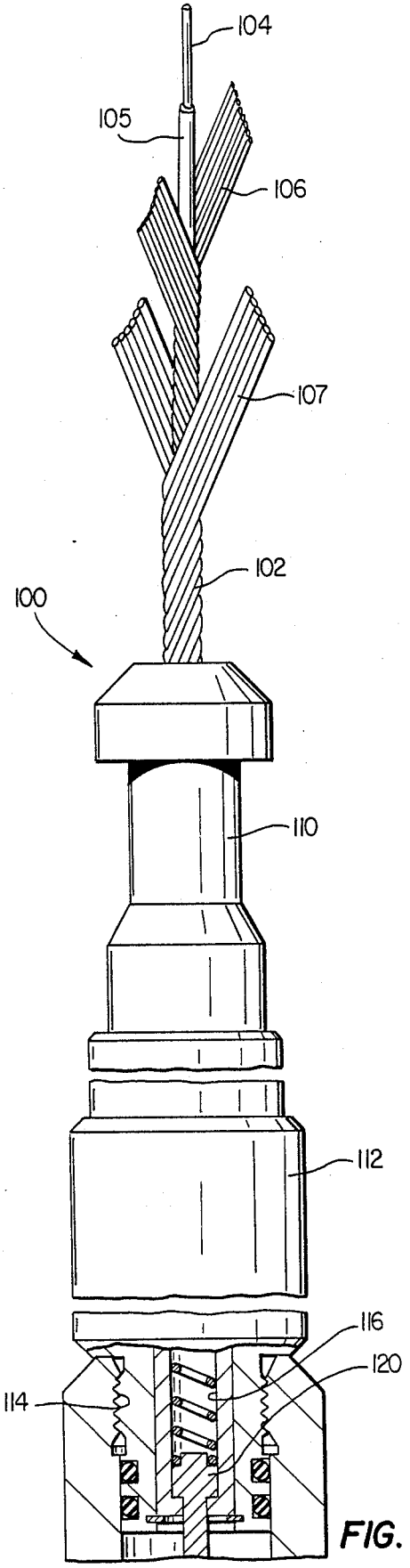
FIGS. 4A–4F taken together, constitute a schematical longitudinal view, partly in section and partly in elevation with some parts broken away, showing the test tool string of FIG. 1 in greater detail.
Figure 4B:
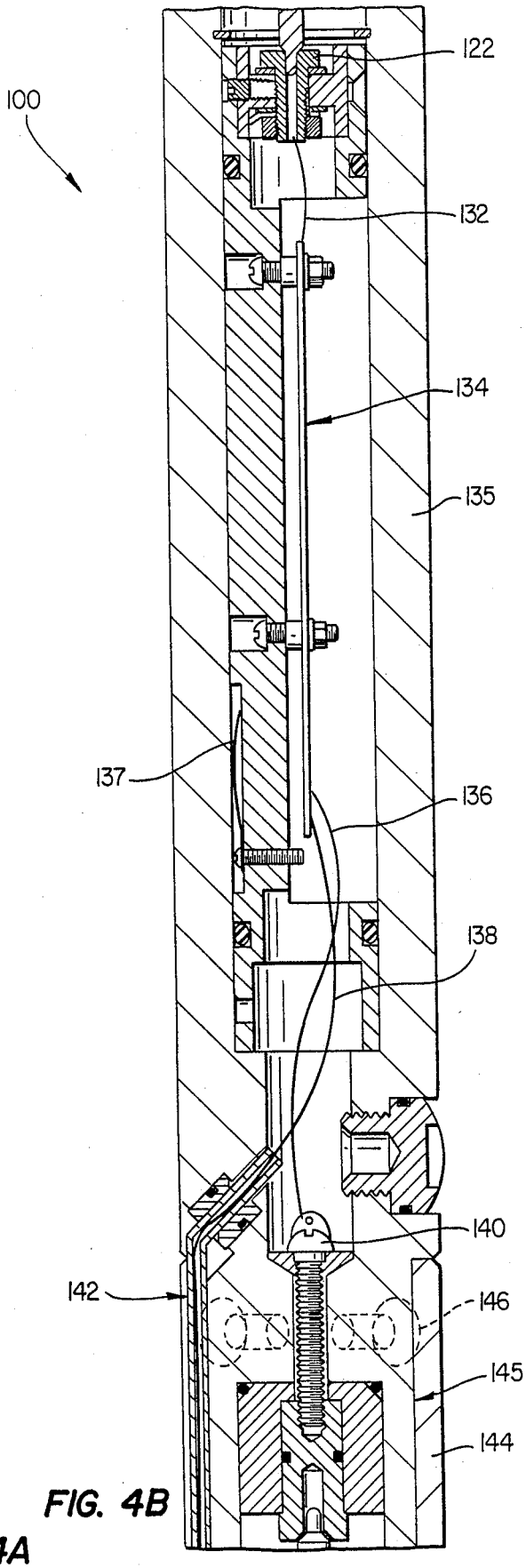
Figure 4C:
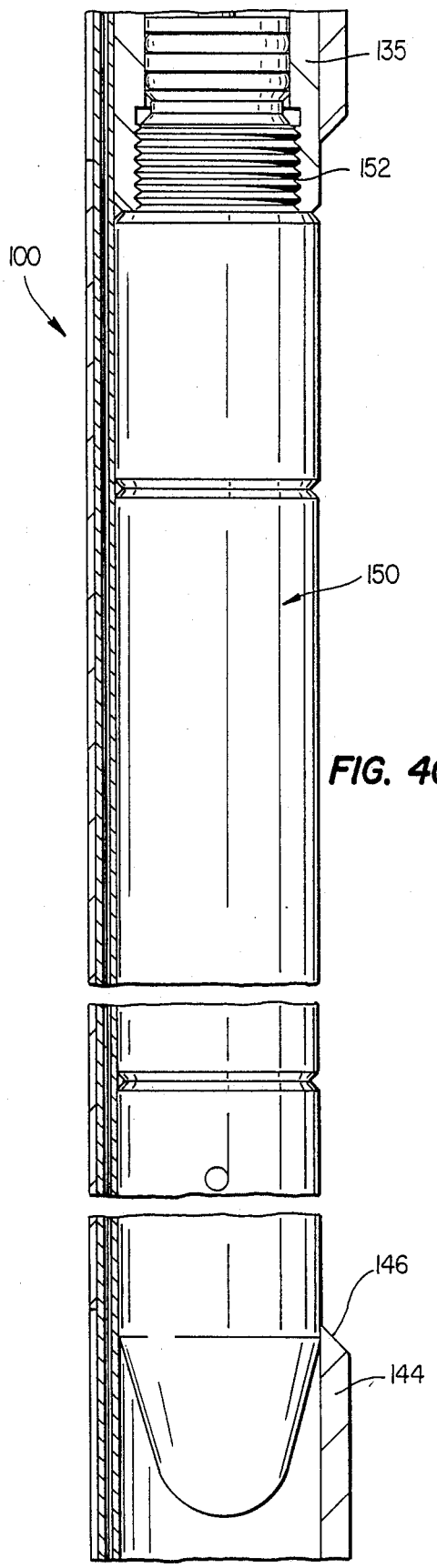
Figure 4D:
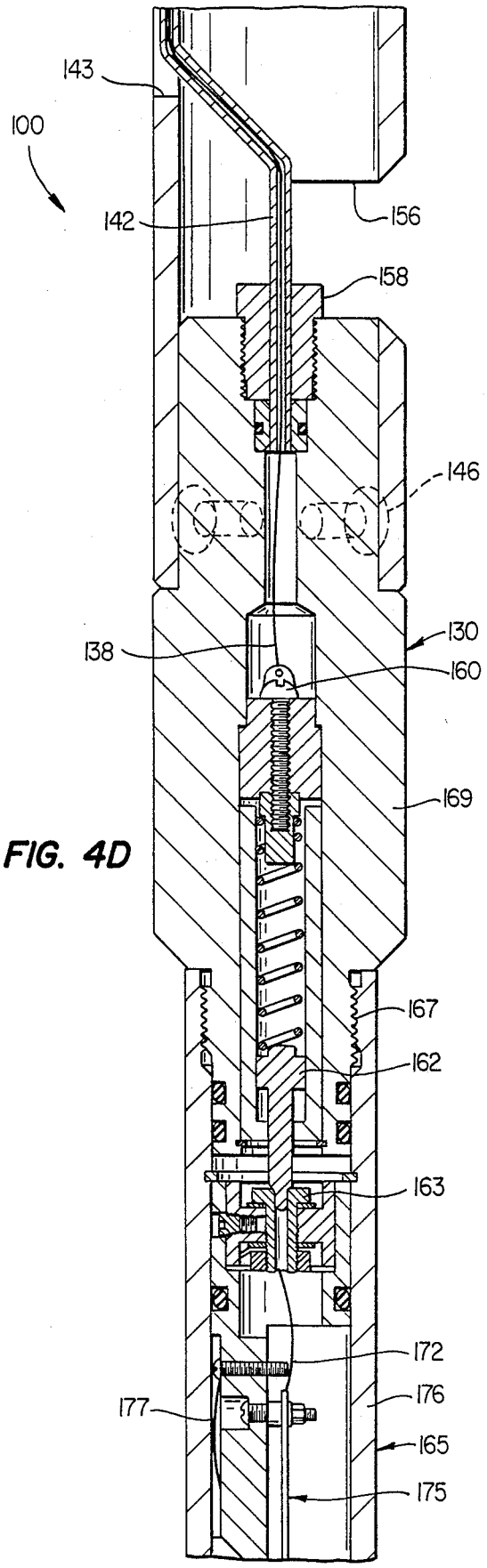
Figure 4E:
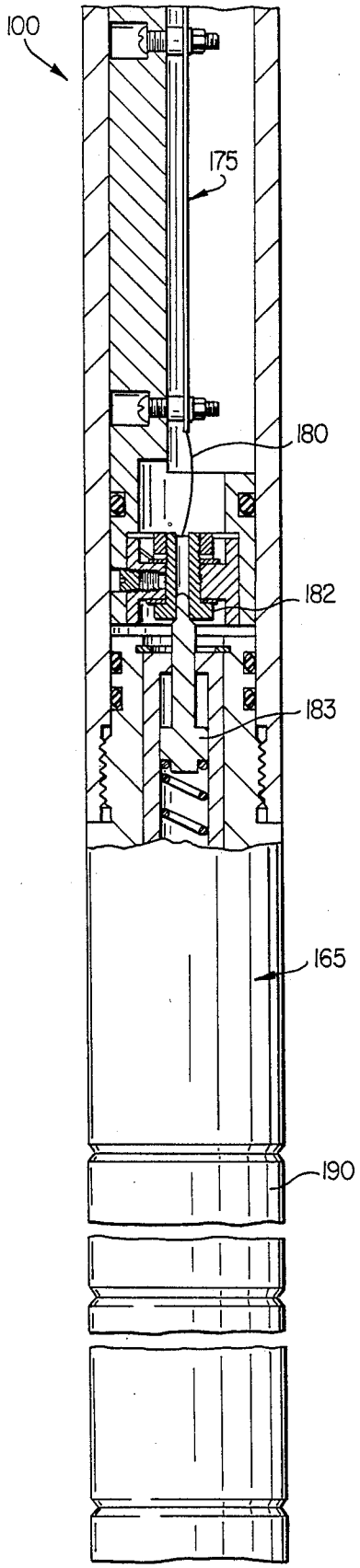
Figure 4F:
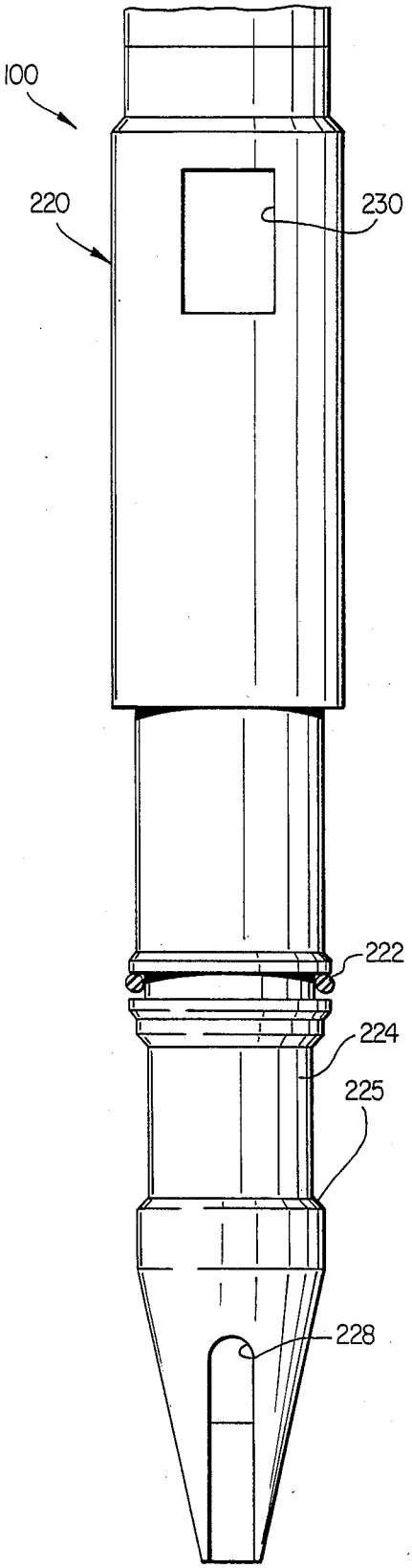

In the schematical view of FIG. 6, the armored cable 102 has its upper end connected to the "wireline outlet" of the signal processor 420. The positive component of the electric cable 102, for purposes of this explanation, is indicated by the reference numeral 104 and thus represents the central conductor wire of the cable as seen in FIG. 4A. The negative component of the electric cable 102 is indicated by the reference numeral 107*a* and here represents the armor of the cable 102 seen in FIG. 4A. The signal processor 420 furnishes electrical power to be carried downhole by the electric cable 102 to power the pressure gages 150 and 190, the temperature gage 165, and the toggle switch 300. In the present example, as explained hereinabove, the downhole power requirement is 21 milliamps at 12.6 volts (the instruments require 21 milliamps at 12 volts). Electrical energy is transmitted down the conductor 104 to the downhole test tool string and returns through the cable armor 107*a*. Signals representing the pressure sensed by the pressure gages and the temperatures sensed by the temperature gage are transmitted to the surface through the conductor wire 104. Signals from the pressure and temperature gages are superimposed upon the 12-volt direct current supply and are thus transmitted to the surface. These pressure and temperature signals are in the form of alternating current generated by oscillator means carried in each of the pressure and temperature gages. The frequencies of such signals correspond to the pressures or temperatures sensed by the downhole gages. The signals from the pressure gages are in the range of about 8 to 25 kilohertz while the signals from the temperature gage are in a much lower range, from about 200 to 400 hertz.

The signals arriving at the signal processor 420 from the lower pressure gage are separated by the signal processor and are sent via cables 421 and 422 to the VHF switch 425 which passes then on to the counter 415 via cable 426. Upon command of the computer, under control of suitable software (not shown), the counter samples the temperature signal and determines its frequency. This frequency is sent to the computer via interface bus 445 for storage, printout, and/or display. In the same manner, the pressure signal is sampled by the counter and its frequency determined, then this determination is sent to the computer where it is corrected in accordance with the temperature just determined and is then stored, printed and/or displayed. Having stored the pressure and temperature just sensed at the lower pressure gage, the pressure at the upper pressure gage is next determined, so the computer 410, under control of the software, commands the VHF switch to connect the adjustable power supply to the cable 102 to input an electrical impulse of 75 milliamps. This pulse is sent via cable 428 from the VHF switch to cable 102 and down the conductor 104 thereof the tool string causing the toggle switch 300 of FIG. 5 to turn off transistor Q1 and to turn on transistor Q2 to switch power from the lower pressure gage and temperature gage to the upper pressure gage.

The upper pressure gage being now on its signals arrive at the signal processor and are processed and corrected according to the temperature just determined and sent to the computer for storage, printout, and/or display as explained with respect to signals from the lower pressure gage.

The current meter 500 may be a separate item from the other components of the surface readout equipment 400, or it may be built into one of the components thereof, the adjustable power supply 430, for instance. In either case, the current meter 500 is used in making ready the surface readout equipment to adjust the adjustable power supply so that its output current meets the requirements, in this case 75 milliamps.

Figure 7:
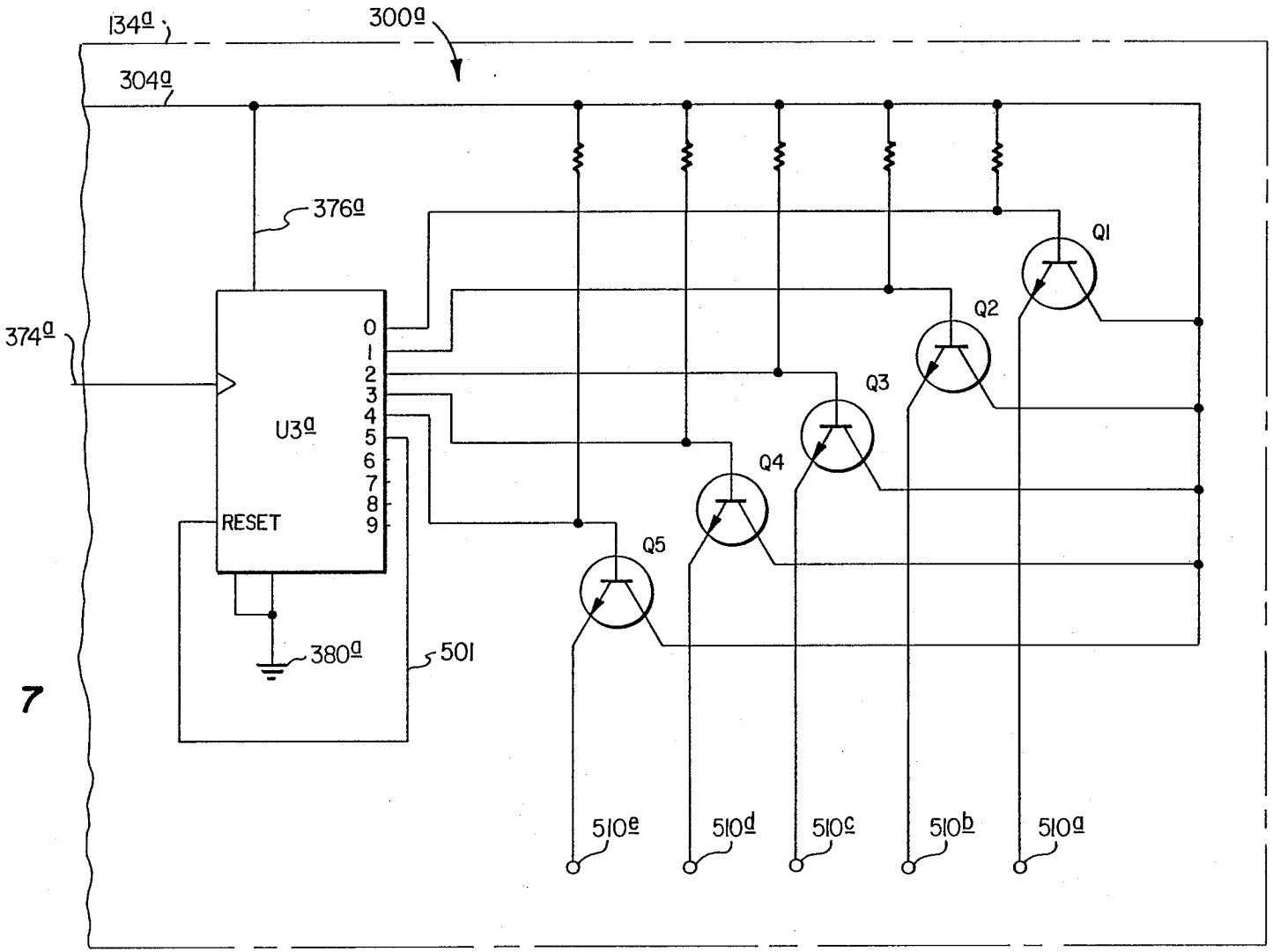
FIG. 7 is a schematical view of a modification of FIG. 5.

Referring to FIG. 7, it will be seen that a modified form of circuitry is provided. In this view, the circuit 300*a* is shown to be on a circuit board 134*a* and is similar to the electronic toggle switch circuit 300 of FIG. 5 but makes possible the operation of as many as ten electrically powered devices in a predetermined sequence.

The power is supplied as before explained, but the current needs to be suitable for the devices to be operated. The power arrives at an input terminal (not shown) which would be the equivalent of input terminal 302 in circuit 300. The power flows through conductor 304*a* and on to the outlet terminals. Circuit 300*a*, while it provides for ten devices, is shown to have five output terminals which are indicated by reference numerals 510*a*, 510*b*, 510*c*, 510*d*, and 510*e*. These five output terminals are controlled by five transistors, Q1, Q2, Q3, Q4, and Q5, respectively. These five transistors are connected to the first five of 10 outputs (0, 1, 2, 3, 4, 5, 6, 7, 8, and 9) provided on the device U3*a* which is a decade counter such as that identified as the RCA 4017B.

Decade counter U3*a* is placed in the circuit 300*a* in the same position occupied by the flip-flop U3.

Decade counter U3*a* is grounded as at 380*a* and receives power from conductor 304*a* through conductor 376*a*. It responds to signals received from one-shot 42 through conductor 374*a*.

Each transistor Q1–Q5 receives power from conductor 304*a* through a branch conductor, as shown, and when one of the transistors is on, permits such power to flow to its associated output terminal and to the device (not shown) connected thereto. For instance, when transistor Q1 is on, electrical energy can flow from conductor 304*a* through branch conductor 304*b* to and through transistor Q1 to terminal 510*a*.

When sequencer circuit 500 is powered up, the decade counter U3*a* will always begin by turning on transistor Q1 since this transistor is connected to its first output which is known as output "0". In like manner, the other four transistors are connected to the decade counter at the next four outputs. Thus the five transistors are connected to decade counter outputs 0, 1, 2, 3, and 4.

The decade counter will automatically begin with the "0" output, as before explained, and when it receives a triggering impulse from the one-shot U2, will turn off transistor Q1 and turn on transistor Q2 because it de-energizes output "0" and energizes output "1". Each time a triggering impulse is received by the decade counter it will sequence to the next output. Ordinarily, it would sequence through the ten outputs in numerical order, but if it has less than ten devices under its control time will be wasted by energizing outputs, which have nothing connected thereto. In such case, a jumper wire such as wire 501 is used to connect the reset output with the lowest numbered empty output. In the case illustrated in FIG. 7, five outputs are occupied and output 5 is the empty output having the lowest number. For that reason, the jumper wire is connected between the reset output and output number 5. Now, when the decade counter, in sequencing, passes output "4" (to which transistor Q5 is connected), it will sequence to output number 5, causing the reset circuit to immediately rest the sequencing to output "0" and thus begins another sequence with transistor Q1.

Thus, as many as ten devices may be connected to the outputs 0–9 of the decade counter and be operated in sequence in the order explained above, the sequencing advancing one step each time that the decade counter receives a triggering impulse from the one-shot.

Thus, it has been shown that systems, apparatus, toggling and sequencing switching means, as well as well testing methods, have been provided which fulfill the objects of invention set forth early in this application.

The foregoing description and drawings are explanatory only, and various changes in sizes, shapes, and arrangement of parts, as well as changes in certain details of the illustrated construction, or variations in the methods, may be made within the scope of the appended claims without departing from the true spirit of the invention.

We claim:

1. A system for testing a subterranean earth formation, comprising:

(a) a well bore penetrating said earth formation to be tested;

(b) a well casing in said well bore extending from the surface into said earth formation, said well casing being perforated opposite said earth formation to permit formation fluids to enter said well casing;

(c) a well tubing in said well casing, said well tubing having a well packer sealing between the exterior of said well tubing and said well casing at a location above said earth formation, said well tubing also having a landing receptacle located near said well packer.

(d) a test tool string means lowered from the surface on a single-conductor electric cable and lockingly and sealingly engaged in said landing receptacle, said test tool string including:

(i) valve means including telescoped tubular members having lateral flow ports in their walls, and being relatively slidable longitudinally between positions opening and closing said flow ports for permitting or preventing flow therethrough, (ii) first pressure sensing means for sensing fluid pressures below said valve means, (iii) second pressure sensing means for sensing fluid pressures above said valve means, and (iv) switching means connected to both said first and second pressure sensing means for alternately switching electric power, transmitted to it from the surface through said electric cable, therebetween, each said pressure sensing means, in turn, generating a signal and transmitting the same to the surface to indicate the magnitude of the pressures sensed thereby; and (e) surface readout equipment connected to said electric cable for supplying power to said first and second pressure sensing means and for receiving the signals generated thereby and processing the same for display and/or recording.

2. The system of claim 1 wherein said test tool string further includes temperature sensing means for sensing well temperature and generating a suitable signal and transmitting the same to the surface readout equipment for processing and display and/or recording, said temperature sensing means being associated with a selected one of said pressure sensing means.

3. The system of claim 1 or 2, wherein said valve means for shutting in said well at said landing receptacle or opening it up is operable between open and closed positions responsive to said electric cable being tensioned and relaxed.

4. A system for testing subterranean earth formations of a well having an upper and a lower producing zone, comprising:

(a) a well bore traversing vertically spaced apart upper and lower earth formations;

(b) a well casing in said well bore extending from the surface at least into said lower earth formation, said well casing being perforated opposite both said upper and lower earth formations to admit formation fluids from said earth formations into said well casing;

(c) a well tubing in said well casing, said well tubing including a well packer sealing between said well tubing and said well casing at a location between said upper and lower earth formations, said well tubing including a landing receptacle located near said well packer, said well tubing also including means providing a lateral flow port near said upper production zone for admitting production fluids therefrom into the well tubing;

(d) a test tool string lowered from the surface on a single-conductor electric cable and lockingly and sealingly engaged in said landing receptacle, said test tool string including:

(i) valve means including telescoped tubular members having lateral flow ports in their walls, and being relatively slidable longitudinally between positions opening and closing said flow ports for permitting or preventing flow therethrough, (ii) a test tool having means thereon for anchoring and sealing said test tool string in said landing receptacle, and (iii) pressure sensing means for sensing fluid pressures of said upper and lower producing zones, said pressure sensing means including:

(1) a first electrically-powdered pressure gage for sensing the pressure of the production fluids from said lower production zone and generating a suitable signal and transmitting it through said electric cable to the surface to indicate the magnitude of the pressure sensed thereby, (2) a second electrically-powered pressure gage for sensing fluid pressures of production fluids from said upper production zone and generating a suitable signal and transmitting it through said electric cable to the surface to indicate the magnitude of the pressure sensed thereby, and (3) switching means connected to both said first and second pressure gages for alternately switching power, transmitted to it from the surface through said electric cable, therebetween, each said pressure gage in turn, generating a signal and transmitting it to the surface; and (e) surface readout equipment connected to said electric cable for supplying power to said first and second pressure gages and for receiving the signals generated thereby and processing such signals for display and/or recording.

5. The system of claim 4, wherein said valve means for shutting-in said well at said landing receptacle or opening it up is operable between open and closed positions responsive to said electric cable being tensioned and relaxed.

6. The system of claim 5, wherein said means providing said lateral flow port in said well tubing is a side pocket mandrel.

7. The system of claim 6, wherein a flow control device is disposed in said side pocket mandrel to control entry of production fluids into said well tubing through said lateral flow port, said flow control device being provided with a flow restrictor.

8. The system of claim 5, 6, or 7, wherein said test tool string further includes temperature sensing means for sensing the temperature of production fluids from said lower production zone, generating a suitable signal in response thereto and transmitting such signal to the surface readout equipment for processing and display and/or recording, said temperature sensing means being associated with a selected one of said first and second pressure sensing means.

9. Apparatus for testing a producing formation in a well having a casing, said casing having perforations communicating its bore with said producing formation, a well tubing in said casing and having a landing receptacle at or near said producing formation, and a well packer sealing between said well tubing and casing above said producing formation, said apparatus comprising:

(a) a single-conductor electric cable;

(b) a test tool string lowerable into said well on said cable and engageable in said landing receptacle in locked and sealed relation therewith, said test tool string including:

(i) a test tool having means thereon for anchoring said test tool string in said landing receptacle in locked and sealed relation, and valve means including telescoped tubular members having lateral flow ports in their walls, and being relatively slidable longitudinally between positions opening and closing said flow ports for permitting or preventing flow therethrough, (ii) first pressure sensing means for sensing fluid pressures below said valve means, (iii) second pressure sensing means for sensing fluid pressures above said valve means, and (iv) switching means connected to both said first and second pressure sensing means for alternately switching electrical power, transmitted thereto from the surface through said electric cable, therebetween, each said first and second pressure sensing means, in turn, generating a suitable signal and transmitting the same to the surface to indicate the magnitude of the pressures sensed thereby; and (c) surface readout equipment connected to said electric cable for supplying power to said first and second pressure sensing means and for receiving said signals generated thereby and processing them for display and/or recording.

10. The apparatus of claim 9, wherein said tool string further includes temperature sensing means for sensing the temperature of well fluids and generating a suitable signal and transmitting the same to the surface readout equipment for processing and display and/or recording, said temperature sensing means being associated with a selected one of said pressure sensing means.

11. The apparatus of claim 10, wherein said switching means is an electronic sequencing device connected between said electric cable and said first and second pressure sensing means for alternately switching electrical current thereto in sequence, said sequencing device comprising:

(a) an input terminal connectable to a source of electrical energy;

(b) a plurality of output terminals connectable to said first and second pressure sensing means;

(c) a plurality of transistor means controlling flow of electrical current from said input terminal to each of said output terminals;

(d) circuit means electrically connecting said input terminal with each of said plurality of output terminals in predetermined sequence, said circuit means including:

(i) resistor means connected between said input terminal and said plurality of transistor means, (ii) voltage divider means including a first voltage divider connected between said input terminal and said resistor means and a second voltage divider connected between said resistor means and said plurality of transistor means, (iii) comparator means connected to said first and second voltage divider means and having the capability of comparing the resultant voltages therefrom and generating an electrical pulse in response to detecting a predetermined difference between the compared voltages, (iv) one-shot means for receiving said electrical pulse generated by said comparator means and having the ability to generate an electrical pulse in response thereto, (v) counter means for turning on and off each of said plurality of transistor means in predetermined sequence to permit electrical current to flow therethrough from said input terminal to each of said plurality of output terminals to turn, said counter means turning off one transistor means and turning on the next transistor means in response to each signal generated by said one-shot means.

12. The apparatus of claim 9, 10, or 11, wherein said valve means for controlling fluid flow through said landing receptacle is operable between open and closed positions responsive to tensioning and relaxing said electric cable.

13. Apparatus for testing producing formations in a well having a well casing, said casing having perforations communicating its bore with upper and lower producing zones, a well tubing in said well casing having a landing receptacle near said lower producing zone and a well packer sealing between said well tubing and said casing at a location between said upper and lower producing zones, said well tubing also having means providing a lateral inlet port above said well packer and near said upper producing zone for admitting production fluids from said upper producing zone into said well tubing, said apparatus comprising:

(a) a single-conductor electric cable;

(b) a test tool string connectable to said electric cable and lowerable thereby into said well tubing and engageable in said landing receptacle in locked and sealed relation therewith said test tool string including:

(i) a test tool having means thereon for anchoring said test tool string in said landing receptacle in locked and sealed relation, and valve means including telescoped tubular members having lateral flow ports in their walls, and being relatively slidable longitudinally between positions opening and closing said flow ports for permitting or preventing flow therethrough, (ii) first pressure sensing means for sensing the pressure of production fluids from said lower producing zone, (iii) second pressure sensing means for sensing the pressure of production fluids from said upper producing zone, and (iv) switching means connected to both said first and second pressure sensing means for alternately switching electrical power, transmitting thereto from the surface through said electric cable, therebetween, each said first and second sensing means, in turn, generating suitable signals and transmitting them to the surface to indicate the magnitude of the pressures sensed thereby; and (c) surface readout equipment connected to said electric cable for supplying power to said first and second pressure sensing means and for receiving said signals generated thereby and processing them for display and/or recording.

14. The apparatus of claim 13, wherein said tool train further includes temperature sensing means for sensing the temperature of well fluids and generating a suitable signal and transmitting the same to the surface readout equipment for processing and display and/or recording, said temperature sensing means being associated with a selected one of said first and second pressure sensing means.

15. The apparatus of claim 14, wherein said switching means is an electronic sequencing device connected between said electric cable and said first and second pressure sensing means for alternately switching electrical current thereto in sequence, said sequencing device comprising:

(a) an input terminal connectable to a source of electrical energy;

(b) a plurality of output terminals connectable to said plurality of electrically-powered well tools;

(c) a plurality of transistor means controlling flow of electrical current from said input terminal to each of said output terminals;

(d) circuit means electrically connecting said input terminal with each of said plurality of output terminals in predetermined sequence, said circuit means including:

(i) resistor means connected between said input terminal and said plurality of transistor means, (ii) voltage divider means including a first voltage divider connected between said input terminal and said resistor means and a second voltage divider connected between said resistor means and said plurality of transistor means, (iii) comparator means connected to said first and second voltage divider means and having the capability of comparing the resultant voltages therefrom and generating an electrical pulse in response to detecting a predetermined difference between the compared voltages, (iv) one-shot means for receiving said electrical pulse generated by said comparator means and having the ability to generate an electrical pulse in response thereto, (v) counter means for turning on and off each of said plurality of transistor means in predetermined sequence to permit electrical current to flow therethrough from said input terminal to each of said plurality of output terminals in turn, said counter means turning off one transistor means and turning on the next transistor means in response to each signal generated by said one-shot means.

16. The apparatus of claim 13, 14, or 15 wherein: said valve means for controlling fluid flow through said landing receptacle is operable between open and closed positions responsive to tensioning and relaxing said electric cable.

17. The system of claim 16, wherein said means providing said lateral flow port in said well tubing is a side pocket mandrel.

18. The system of claim 17, wherein a flow control device is disposed in said side pocket mandrel to control entry of production fluids into said well tubing through said lateral flow port, said flow control device being provided with a flow restrictor.

19. A test tool for use in testing a subterranean well formation, the test tool being lowerable into the well on a single-conductor electric cable and locked and sealed in a landing receptacle which forms a part of a well tubing disposed in the well and having a lower portion communicating with the well formation, the test tool comprising:

(a) an elongate body means having a longitudinal flow passage therethrough;

(b) means on said elongate body means for anchoring the same in said landing receptacle of said well tubing in locked and sealed relation therewith;

(v) valve means carried on said elongate body, said valve means including telescoped tubular members having lateral flow ports in their walls, and being relatively slidable longitudinally between positions opening and closing said flow ports for permitting or preventing flow therethrough, said valve means being actuable between open and closed positions in response to tensioning and relaxing said electric cable;

(d) pressure sensing means above said anchoring means, including:

(i) a first electrically-powered pressure sensor for sensing the pressure of fluids below said valve means, said first pressure sensor having means for generating suitable electrical signals for transmission to the surface through said electric cable to indicate the magnitude of the pressures sensed, (ii) a second electrically-powered pressure sensor for sensing the pressure of fluids above said valve means, said second pressure sensor having means for generating suitable electrical signals for transmission to the surface through said electric cable to indicate the magnitude of the pressures sensed, and (iii) switching means connected to both said first and second pressure sensors and to said electric cable for alternately switching electric power thereto at predetermined intervals; and (e) means for connecting said test tool string to said electric cable.

20. The test tool of claim 19, wherein said test tool further includes an electrically-powered temperature sensor associated with a selected one of said pressure sensor means, for sensing the temperature of well fluids and generating corresponding signals for transmission to the surface for processing and display and/or recording, said signals being transmitted to the surface together with signals from said selected one of said pressure sensors.

21. The test tool of claim 19, wherein said switching means is an electronic sequencing device for switching three or more well tools on and off in predetermined sequence.

22. The test tool of claim 19, wherein said switching means is an electronic sequencing device which is triggerable in response to an electrical pulse sent downhole from the surface, said sequencing device comprising:

(a) an input terminal connectable to a source of electrical energy;

(b) a plurality of output terminals connectable to said electrically-powered sensing means;

(c) a plurality of transistor means controlling flow of electrical current from said input terminal to each of said output terminals;

(d) circuit means electrically connecting said input terminal with each of said plurality of output terminals in predetermined sequence, said circuit means including:

(i) resistor means connected between said input terminal and said plurality of transistor means, (ii) voltage divider means including a first voltage divider connected between said input terminal and said resistor means and a second voltage divider connected between said resistor means and said plurality of transistor means, (iii) comparator means connected to said first and second voltage divider means and having the capability of comparing the resultant voltages therefrom and generating an electrical pulse in response to detecting a predetermined difference between the compared voltages, (iv) one-shot means for receiving said electrical pulse generated by said comparator means and having the ability to generate an electrical pulse in response thereto, (v) counter means for turning on and off each of said plurality of transistor means in predetermined sequence to permit electrical current to flow therethrough from said input terminal to each of said plurality of output terminals in turn, said counter means turning off one transistor means and turning on the next transistor means in response to each signal generated by said one-shot means.

23. The device of claim 22, wherein said resistor means is adjustable.

24. The device of claim 22, wherein counter means includes means for causing it to begin said sequencing with the same transistor means each time the sequencing device is powered up.

25. The device of claim 22, 23, or 24, wherein said predetermined voltage difference to which said comparator means responds is created as a result of the application of said electrical pulse to said input terminal.

26. The device of claim 25, wherein a Zener diode is connected into its circuitry at a location adjacent said second voltage divider and on the opposite side thereof from said resistor means to limit the voltage across said second voltage divider.

27. The device of claim 26, wherein said first voltage divider is adjustable for establishing the voltage difference across the inputs of said comparator means.

28. The device of claim 26 wherein two output terminals and transistor means are provided for connection of at least two electrically-powered well tools, and said counter means is a flip-flop which toggles to turn off one transistor means and turns on the other transistor means each time it receives a signal generated by said one-shot.

29. The device of claim 28 wherein resistor means is connected between said transistor means and said output terminals as needed to balance the electrical loads of the connected well tools to avoid the need for changing the current supplied thereto as the device sequences power from one of said output terminals to the other.

30. The test tool of claim 20, wherein said switching means is an electronic sequencing device connected between said electric cable and said first and second electrically-powered pressure sensors for alternately switching electrical current thereto in sequence, comprises:

(a) an input terminal connectable to a source of electrical energy;

(b) a plurality of output terminals connectable to said first and second electrically-powered pressure sensors;

(c) a plurality of transistor means controlling flow of electrical current from said input terminal to each of said output terminals;

(d) circuit means electrically connecting said input terminal with each of said plurality of output terminals in predetermined sequence, said circuit means including:

(i) resistor means connected between said input terminal and said plurality of transistor means, (ii) voltage divider means including a first voltage divider connected between said input terminal and said resistor means and a second voltage divider connected between said resistor means and said plurality of transistor means, (iii) comparator means connected to said first and second voltage divider means and having the capability of comparing the resultant voltages therefrom and generating an electrical pulse in response to detecting a predetermined difference between the compared voltages, (iv) one-shot means for receiving said electrical pulse generated by said comparator means and having the ability to generate an electrical pulse in response thereto, (v) counter means for turning on and off each of said plurality of transistor means in predetermined sequence to permit electrical current to flow therethrough from said input terminal to each of said plurality of output terminals in turn, said counter means turning off one transistor means and turning on the next transistor means in response to each signal generated by said one-shot means.

* * * * *